US010531185B1

(12) United States Patent
Lang

(10) Patent No.: US 10,531,185 B1
(45) Date of Patent: Jan. 7, 2020

(54) STACKABLE ACOUSTIC HORN, AN ARRAY OF STACKABLE ACOUSTIC HORNS AND A METHOD OF USE THEREOF

(71) Applicant: BAE Systems Information and Electronic Systems Integration Inc., Nashua, NH (US)

(72) Inventor: David A. Lang, San Diego, CA (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 0 days.

(21) Appl. No.: 16/120,116

(22) Filed: Aug. 31, 2018

(51) Int. Cl.

| | |
|---|---|
| ***H04R 1/00*** | (2006.01) |
| ***H04R 1/32*** | (2006.01) |
| ***H04R 1/40*** | (2006.01) |
| *H04R 9/08* | (2006.01) |
| *H04R 3/00* | (2006.01) |

(52) U.S. Cl.
CPC ..... *H04R 1/326* (2013.01); *H04R 1/406* (2013.01); *H04R 3/005* (2013.01); *H04R 9/08* (2013.01)

(58) Field of Classification Search
CPC ..... H04R 1/326; H04R 1/406; H04R 3/00; H04R 3/005; H04R 9/08; H04R 29/006
USPC ..... 381/91–92
See application file for complete search history.

(56) References Cited

U.S. PATENT DOCUMENTS 2,560,541 A * 7/1951 Barrow ..... H01Q 13/02 343/778
5,832,079 A * 11/1998 Rabe ..... H04M 1/0216 379/433.13
6,737,252 B2 * 5/2004 Hedrick ..... C07K 14/521 435/252.3
8,728,001 B2 * 5/2014 Lynn ..... A61B 5/002 600/529
9,183,826 B2 * 11/2015 Salomaa ..... G10K 11/025
2010/0109481 A1 * 5/2010 Buccafusca ..... G10K 11/025 310/335
2014/0003635 A1 * 1/2014 Mohammad ..... G10K 11/16 381/306
2014/0119588 A1 * 5/2014 LaCarrubba ..... G10K 11/28 381/340
2017/0295429 A1 * 10/2017 Poletti ..... H04R 5/027

OTHER PUBLICATIONS www.ecvv.com/product/4177193.html, Guangzhou J.Sound Audio Equipment Parts Co., Ltd., Acoustic Accessories of Pro Sound Speaker Horn, publicly available as of Jun. 19, 2018, 3 pages.

* cited by examiner

*Primary Examiner* — Disler Paul
(74) *Attorney, Agent, or Firm* — Sand, Sebolt & Wernow LPA; Scott J. Asmus

(57) ABSTRACT

A stackable horn configured such that a plurality of substantially identical horns can be stacked to form an array. Each horn diminishes in interior area from a mouth to a throat thereof and is vertically taller and longitudinally deeper than it is wide. The horn or array may be secured to a support. In the array, the horns are similar or identical and are arranged side-by-side with a space in between or in abutting contact. An aperture is defined in the throat of each horn and a microphone is positioned within the throat of each horn in the array. The arrangement of horns in the array permits beamforming and as a result allows simultaneous detection, tracking, and identification of multiple targets. Listening distance is greatly increased by utilizing the horn or the array of horns.

22 Claims, 23 Drawing Sheets

STACKABLE ACOUSTIC HORN, AN ARRAY OF STACKABLE ACOUSTIC HORNS AND A METHOD OF USE THEREOF

BACKGROUND

Technical Field

The present disclosure relates generally to listening devices. More particularly, the present disclosure is directed to a stackable acoustic horn that when combined with a microphone, improves both the gain and directivity of the microphone and allows listening to a sound source (target) at a much greater distance than with the microphone itself. A plurality of stackable acoustic horns may be configured into an array that can use beamforming to simultaneously focus on multiple distant and separate targets of interest.

Background Information

Directional microphones have been utilized in the past to listen to a target that is located a distance away from the microphone. These directional microphones, which include parabolic dishes and shotgun microphones, may have a relatively limited distance over which they may be used to reliably detect a sound. They are also only capable of listening in one direction at a time, being limited to the direction in which the microphone is pointed.

Other microphones, such as omnidirectional microphones, may be used in an array, allowing the ability to listen in more than one direction at a time, but to achieve a similar distance as a parabolic dish a large array of omnidirectional microphones must be used, which is often cost prohibitive.

Beamforming, i.e., spatial filtering, is well known to be useful to improve the ability to separate sound-producing objects or targets of interest from other targets simultaneously producing sound from a separate location. The problem with previously known directional microphones is that they have to be used individually and cannot be assembled into an array. Therefore, these directional microphones must be mechanically pointed. Digital beamforming, as currently known, is therefore typically accomplished by utilizing a plurality of omnidirectional microphones. A group of omnidirectional microphones may therefore be placed close to each other. Beamforming and electronic pointing may then be performed on data collected from the group of microphones, typically at a much higher cost than mechanically pointed microphones.

Directional-type microphones such as parabolic dishes, shotgun microphones may be used to capture sound from a target of interest and exclude sound from targets outside their beam. However, because these devices only point and therefore listen in one direction, if it is desired to collect data in multiple directions, then multiple separate microphones are needed. If the target is moving then microphones also need to be dynamically mechanically pointed. Since these physical structures have narrow beams and typically cannot be placed close to each other, they are not amenable to digital beamforming due to spatial aliasing constraints.

SUMMARY

The present disclosure relates to an acoustic device that is in the form of a stackable horn. The horn is configured such that a plurality of substantially identical horns can be stacked one next to the other to form an array. The array of horns is able to be utilized to simultaneously, listen to and separate acoustic signals emanating from multiple targets. The ability to listen to multiple targets at greater distances is accomplished by using the stackable horn in an array. The stackable horn increases the listening distance of each microphone. Configuring the stackable horns in an array provides the beamforming capability, which provides an ability to electronically point in a particular direction or multiple directions and increases the listening distance.

Each horn diminishes in interior area from a mouth to a throat thereof. Each horn is vertically taller and longitudinally deeper than it is wide. The horn or array may be secured to a support. An aperture is defined in the throat of the horn and a microphone is positioned inside the aperture. In the array, the horns are similar or identical and are arranged side-by-side with a space in between or in abutting contact. A microphone is positioned within the throat of each horn in the array. The arrangement of horns in the array permits beamforming and as a result allows simultaneous detection, tracking, and identification of multiple targets. Listening distance is greatly increased by utilizing the horn or the array of horns.

In particular, the stackable acoustic horn of the present disclosure is capable of listening to objects that are located at a distance approximately ten times greater than a microphone on its own. If, for example, a microphone is able to reliably detect sounds from objects located about 8 feet (2.45 m) from the microphone, the stackable horn reliably detects sounds from objects located about 80 feet (24.3 m) from the horn, i.e., about ten times the distance possible with the microphone on its own. An array of twenty-four stackable horns using the example microphone would be capable of detecting sounds from objects located about 400 feet (121.8 m) away from the array, i.e., about fifty times the distance possible with the microphone on its own.

Depending on the orientation of the horn, the stackable acoustic horn of the present disclosure has a very broad beam in a first direction (e.g. horizontal) and a narrow beam (e.g. vertical) in a second direction. The structure is tall in the second direction (e.g. vertical) and narrow in the first direction (e.g. horizontal). The physical shape allows the stackable horns to be placed next to each other in an array. This allows digital beamforming and the ability to listen to many sound sources at once. The stackable horn provides gain and directivity like a parabolic dish, but has the advantage that it may be placed side-by-side with other stackable horns.

In one aspect, the present disclosure may provide a method of locating, tracking and/or identifying objects producing sound, comprising a plurality of horns that each have a substantially planar first side and a substantially planar second side; arranging the plurality of horns in an array so that the first side of a first one of the plurality of horns is adjacent the second side of a second one of the plurality of horns; and gathering sound generated by at least one remote object or person utilizing the horns in the array. In one example, the first side of the first one of the plurality of horns is in abutting contact with the second side of the second one of the plurality of horns. In another example, the first side of the first one of the plurality of horns is spaced a distance from the second side of the second one of the plurality of horns. The method may further comprise receiving the gathered sound with microphones provided at a rearward end of each horn in the array. The method may further comprise operatively engaging each of the microphones with a device; and programming the device with software to do one or more of locate, track, and identify objects. The method may further comprise performing a beamforming operation utilizing the array.

In another aspect, the present disclosure may provide a listening device comprising at least one stackable acoustic horn, wherein the at least one stackable acoustic horn has a body comprising a first side; a second side that is opposed to the first side; a top wall and a bottom wall extending between the first side and the second side; wherein the first side, the second side, the top wall and the bottom wall bound and define an interior cavity; a mouth provided at one end of the body; said mouth defining an opening to the interior cavity; a throat provided on the body a distance from the mouth; said throat defining an aperture that is in fluid communication with the interior cavity; wherein the interior cavity has a parametrically decreasing area as viewed from the mouth to the throat. A microphone is carried in the throat of the at least one stackable acoustic horn. The rate of decrease in the area of the interior cavity of the at least one stackable acoustic horn is based on an area of the throat aperture (So) and a lowest frequency of operation of the horn (Fc). The parametrically decreasing area of the interior cavity of the at least one stackable acoustic horn may be determined utilizing one or more exponential equations, conic equations, parabolic equations, hyperbolic equations, and tractrix equations.

In another aspect, the present disclosure may provide a listening device comprising a plurality of stackable acoustic horns that are stacked side-by side to form an acoustic array; wherein each of the plurality of stackable acoustic horns has a body that includes a first side; a second side that is opposed to the first side; a top wall and a bottom wall extending between the first side and the second side; wherein the first side, the second side, the top wall and the bottom wall bound and define an interior cavity; a mouth provided at one end of the body; said mouth defining an opening to the interior cavity; a throat provided on the body a distance from the mouth; said throat defining an aperture that is in fluid communication with the interior cavity; wherein the interior cavity has a parametrically decreasing area as viewed from the mouth to the throat; and a microphone carried in the throat of at least some of the plurality of stackable acoustic horns. A distance from a first side surface of each of the stackable acoustic horns in the acoustic array to a second side surface of each of the stackable acoustic horns in the acoustic array is sufficiently narrow enough to allow the plurality of stackable acoustic horns to be arranged in the acoustic array in a configuration that permits a beamforming function to be performed without spatial aliasing.

In another example, the present disclosure may provide a method of locating, tracking and/or identifying objects utilizing sound comprising stacking a plurality of stackable acoustic horns into an array; decreasing an area of an interior cavity defined in each stackable acoustic horn of the plurality of stackable acoustic horns from a mouth opening of the stackable acoustic horn towards a throat aperture thereof; placing the array in a location and direction that is advantageous for receiving sound from at least one sound-generating object remote from the array, wherein the at least one sound-generating object propagates sound towards the array; receiving the sound from the at least one sound-generating object into the mouth opening of at least some of the plurality of stackable acoustic horns; focusing the received sounds towards the throat aperture of the at least some of the plurality of stackable acoustic horns having the decreasing area of the interior cavity; receiving the focused sound with a microphone carried in the at least some of the plurality of stackable acoustic horns; and performing a beamforming operation utilizing the sound received by the microphones.

The stacking of the plurality of stackable acoustic horns may include spacing a first side surface of each of the plurality of stackable acoustic horns in the array a distance away from a second side surface of each of the plurality of stackable acoustic horns in the array; and selecting the distance between the first side surface and the second side surface to be sufficiently narrow to allow the plurality of stackable acoustic horns to be arranged in the array in a configuration that permits a beamforming function to be performed without spatial aliasing.

In one example, the stacking of the plurality of stackable acoustic horns may include placing a first side of a first stackable acoustic horn of the plurality of stackable acoustic horns in abutting contact with a second side of an adjacent second stackable acoustic horn of the plurality of stackable acoustic horns. In another example, the stacking of the plurality of stackable acoustic horns may include laterally spacing a first side of a first stackable acoustic horn of the plurality of stackable acoustic horns a distance from a second side of an adjacent second stackable acoustic horn of the plurality of stackable acoustic horns.

In one example, decreasing the area of the interior cavity of each stackable acoustic horn in the plurality of stackable acoustic horns may be accomplished by decreasing a distance between a top wall and a bottom wall of each stackable acoustic horn and in a direction moving from the mouth opening to the throat aperture thereof. In another example, decreasing the area of the interior cavity of each stackable acoustic horn in the plurality of stackable acoustic horns may be accomplished by decreasing a distance between a first side and a second side of each of stackable acoustic horn and in a direction moving from the mouth opening to the throat aperture thereof. In another example, decreasing the area of the interior cavity of each stackable acoustic horn in the plurality of stackable acoustic horns is accomplished by folding at least one of the top wall and bottom wall of the at least one stackable acoustic horn toward the other of the top wall and the bottom wall or toward the mouth of the at least one stackable acoustic horn. This folding may occur one or more times on the at least one stackable acoustic horn.

In other examples, the method may further comprise operatively engaging each of the microphones with a computing device and programming the computing device with software to locate, track, and/or identify objects based on the sound they generate and propagate. The method may further include comparing a known acoustic signature for a class of objects with the received sound and identifying the at least one remote, sound-generating objects based on the comparison of the known acoustic signature and the received sound. The area of the interior cavity of each stackable acoustic horn may be decreased parametrically and determining the parametrically decreasing area of each stackable acoustic horn in the plurality of stackable acoustic horns may be undertaken by utilizing one or more exponential equations, conic equations, parabolic equations, hyperbolic equations, and tractrix equations.

BRIEF DESCRIPTION OF THE SEVERAL VIEWS OF THE DRAWINGS

Sample embodiments of the present disclosure are set forth in the following description, are shown in the drawings and are particularly and distinctly pointed out and set forth in the appended claims.

Similar numbers refer to similar parts throughout the drawings.

DETAILED DESCRIPTION

Referring to FIGS. 1-5, there is shown an exemplary first acoustic stackable horn in accordance with the present disclosure, generally indicated at 10. Horn 10 has a mouth 10*a* through which sound enters horn 10 and a throat 10*b* that is located a distance rearwardly away from mouth 10*a*. Acoustic waves enter the mouth 10*a* and travel toward the throat 10*b* to be detected by a microphone.

Horn 10 comprises a first side 10*c*, a second side 10*d*, a top wall 10*e*, and a bottom wall 10*f*. As shown in FIGS. 1-5 and particularly in FIG. 4A, in the first exemplary embodiment of horn 10, first side 10*c* and second side 10*d* are substantially identically configured, are opposed, and are substantially parallel to each other. First side 10*c* and second side 10*d* are flat and a gap is defined between them. The first side 10*c* and second side 10*d* are of a constant distance "D" apart from each other from proximate mouth 10*a* to proximate throat 10*b* of horn 10. Additionally, first side 10*c* and second side 10*d* are of a substantially constant thickness "T" from proximate mouth 10*a* to proximate throat 10*b*. First and second sides 10*c*, 10*d* are aligned along their outer perimeters relative to each other.

Figure 5:
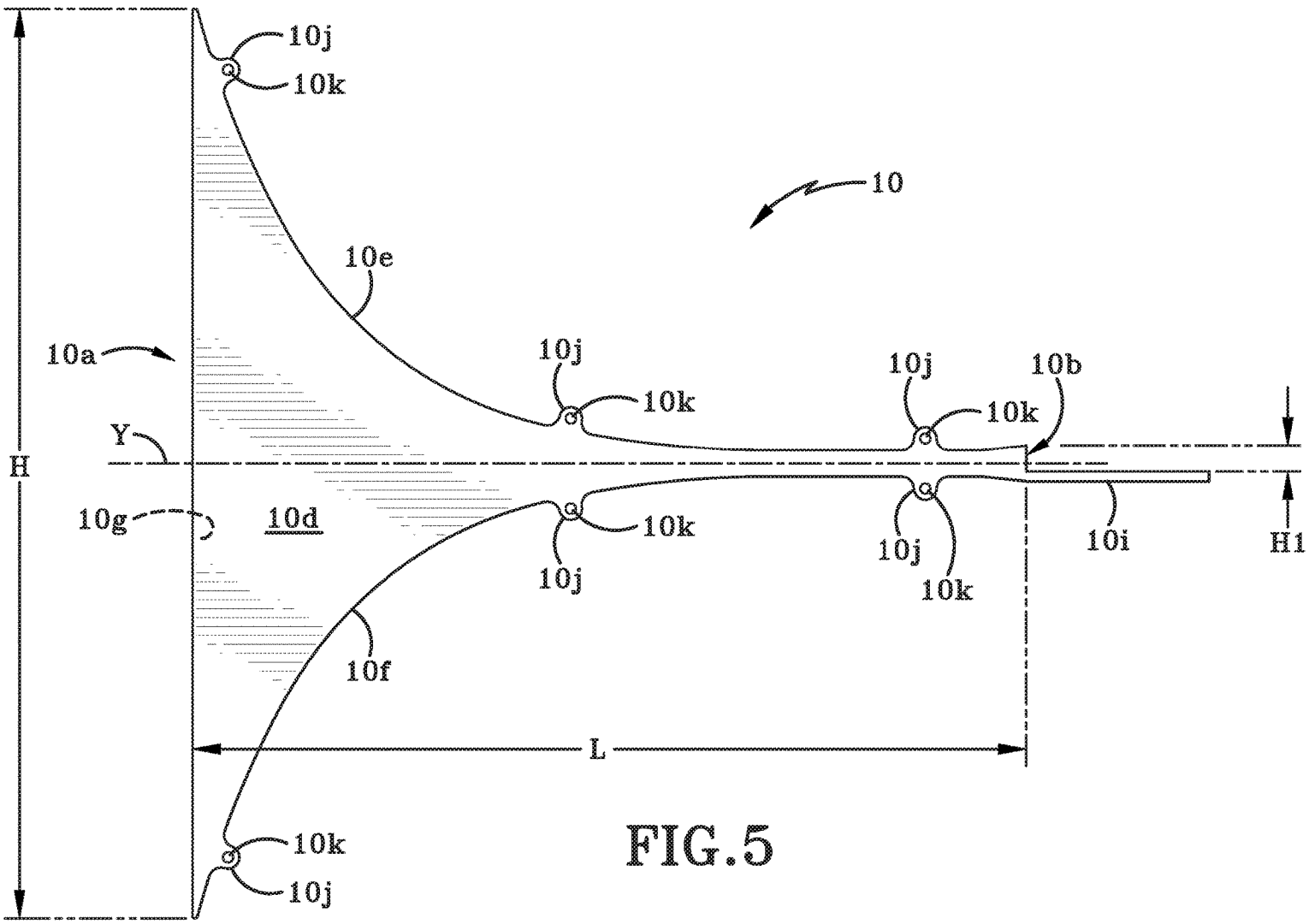
FIG. 5 is a right side elevation view of the horn of FIG. 1; the unshown left side elevation view being a mirror image thereof.

As is shown in FIG. 5, first and second sides 10*c*, 10*d* may be configured to taper in height from mouth 10*a* of stackable acoustic horn 10 towards the throat 10*b* thereof. Additionally, first and second side 10*c*, 10*d* may be configured to be symmetrical about a longitudinal axis "Y" of horn 10.

Top wall 10*e* and bottom wall 10*f* are substantially identically configured and are arranged to extend between first side 10*c* and second side 10*d*. Top wall 10*e* and bottom wall 10*f* are arranged in such a way that they are mirror images of each other. Each of the top wall 10*e* and bottom wall 10*f* extends between a portion of the perimeter of first side 10*c* and a portion of the perimeter of the second side 10*f*. The width of the gap between first and second sides 10*c*, 10*d* is substantially identical to the width of the top wall 10*e* and bottom wall 10*f*.

Top wall 10*e* angles downwardly from mouth 10*a* to throat 10*b*. Bottom wall 10*f* angles upwardly from mouth 10*a* to throat 10*b*. Each of the top and bottom walls 10*e*, 10*f* may be arcuate in shape. The curvature of top wall 10*e* may be oriented opposite to the curvature of bottom wall 10*f*. In particular, each of the top and bottom walls 10*e*, 10*f* may be concavely curved. Top and bottom walls 10*e*, 10*f* may have an inner surface that bounds a portion of an interior cavity 10*h* of horn 10 that is convexly curved. Furthermore, it is possible for the inner surface of top and bottom walls 10*e*, 10*f* to be convexly curved while the outer surface of the top and bottom walls 10*e*, 10*f* is non-concavely curved. When horn 10 is viewed from the right side or left side (such as in FIG. 5) or in cross-section (such as in FIG. 7), the inner surface of horn 10 tapers in height from mouth 10*a* to throat 10*b*.

Figure 1:
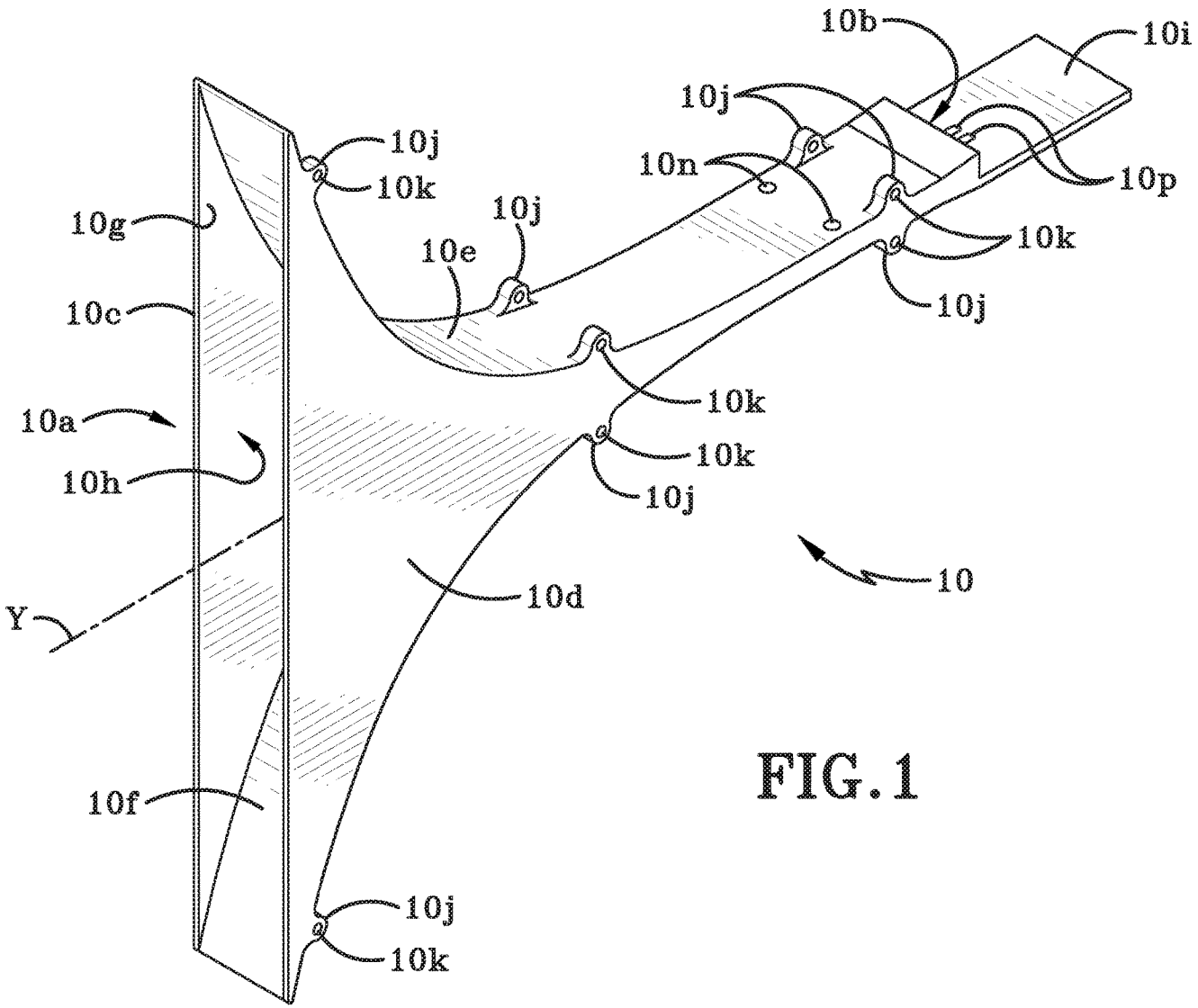
FIG. 1 is an isometric perspective view of a first exemplary embodiment of a single stackable acoustic horn in accordance with the present disclosure.
Figure 2:
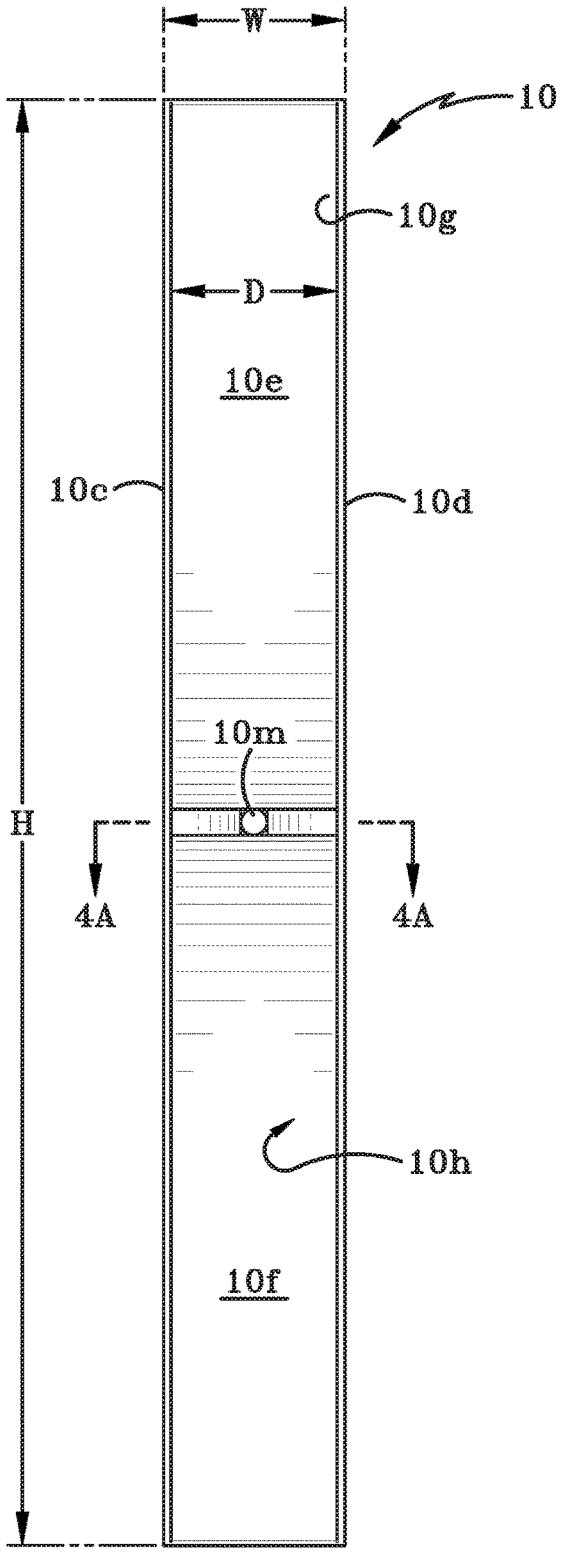
FIG. 2 is a front elevation view of the stackable acoustic horn of FIG. 1.

As is shown in FIGS. 2 and 5, horn 10 may have a height "H", a width "W" and a length "L". Height "H" is measured from the leading edge of top wall 10*e* to the leading edge of bottom wall 10*f*. (The leading edges are those edges that bound and define the opening 10*g* in the mouth 10*a* of horn 10.) Width "W" is measured from the leading edge of first side 10*c* to the leading edge of second side 10*d*. Length "L" is measured from the leading edges that bound and defined opening 10*g* to a rearmost region of throat 10*b*. As can be seen in FIG. 5, second side 10*d* (and the unseen first side 10*c*) tapers in height from height "H" at mouth 10*a* to a height "H1" at throat 10*b*.

In one particular example horn 10 may be considered relatively tall in a vertical direction and relatively thin in a horizontal direction. Horn 10 is also considered relatively long or deep in a longitudinal and horizontal direction.

An opening 10*g* is provided at mouth 10*a* of horn 10. Opening 10*g* provides an entrance into the interior cavity 10*h* of horn 10. Opening 10*g* is bounded and defined by the leading edges of first side 10*c*, second side 10*d*, top wall 10*e*, and bottom wall 10*f*. Interior cavity 10*h* is bounded and defined by first side 10*c*, second side 10*d*, top wall 10*e*, and bottom wall 10*f*. Opening 10*g* is in fluid communication with interior cavity 10*h*. Interior cavity 10*h* is widest proximate opening 10*g* and the area tapers progressively towards throat 10*b* of horn 10.

Figure 3:
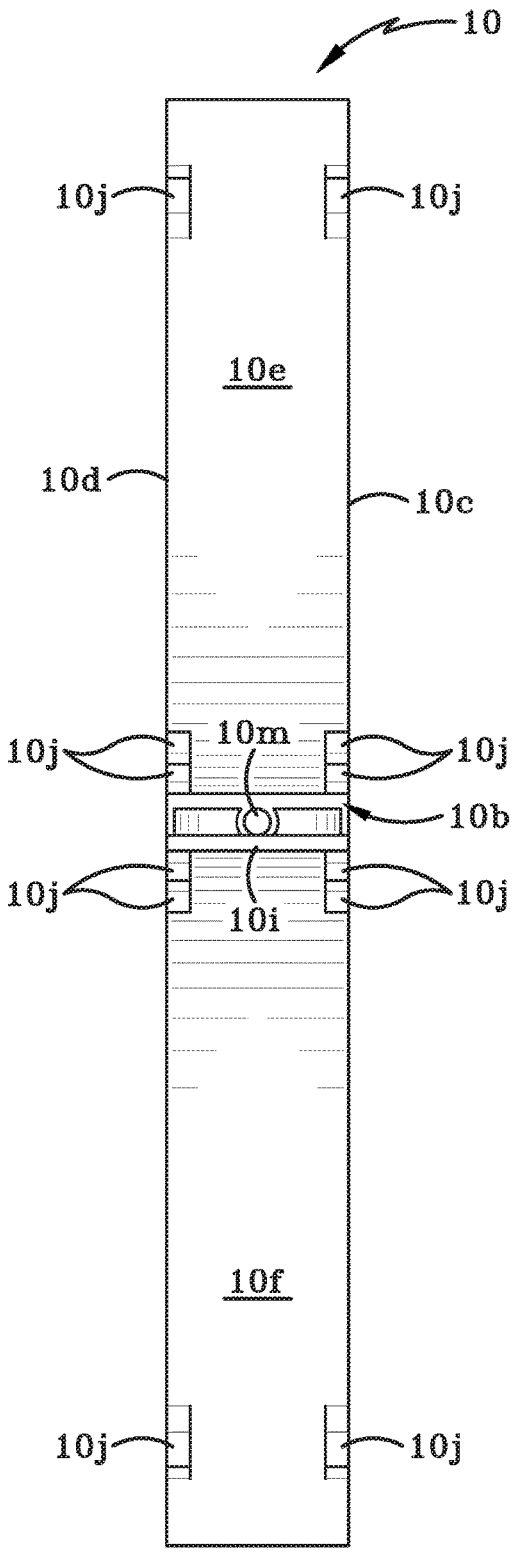
FIG. 3 is a rear elevation view of the stackable acoustic horn of FIG. 1.
Figure 4:
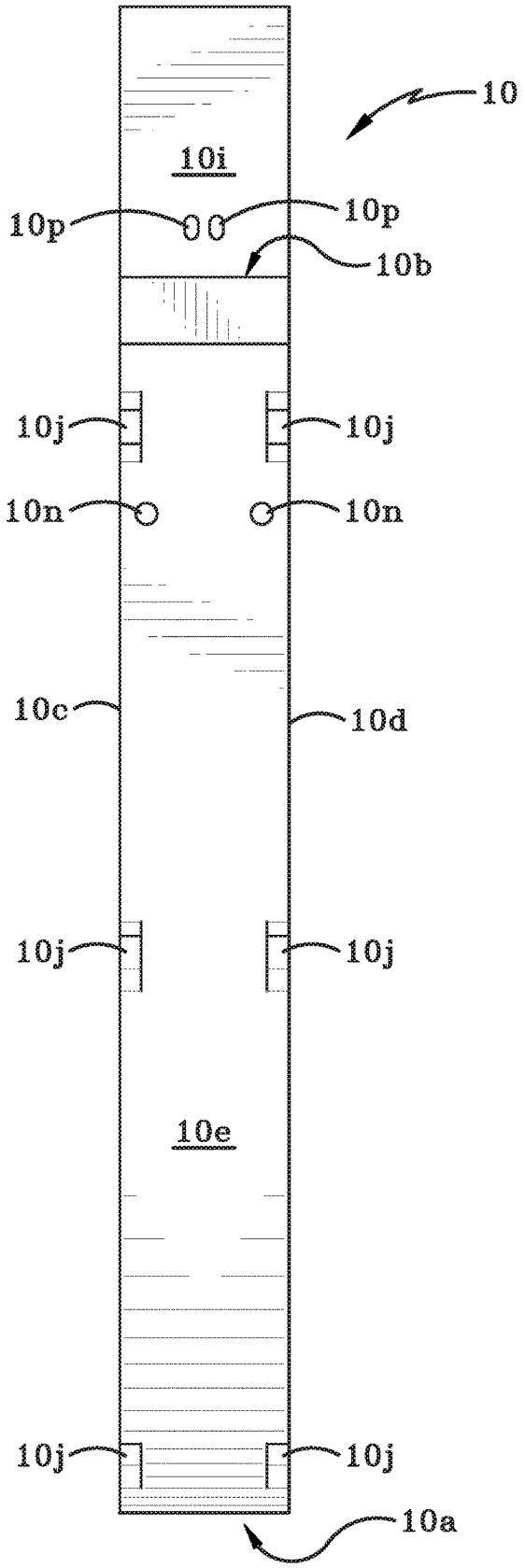
FIG. 4 is a top plan view of the horn of FIG. 1; the unshown bottom plan view being a mirror image thereof.
Figure 4A:
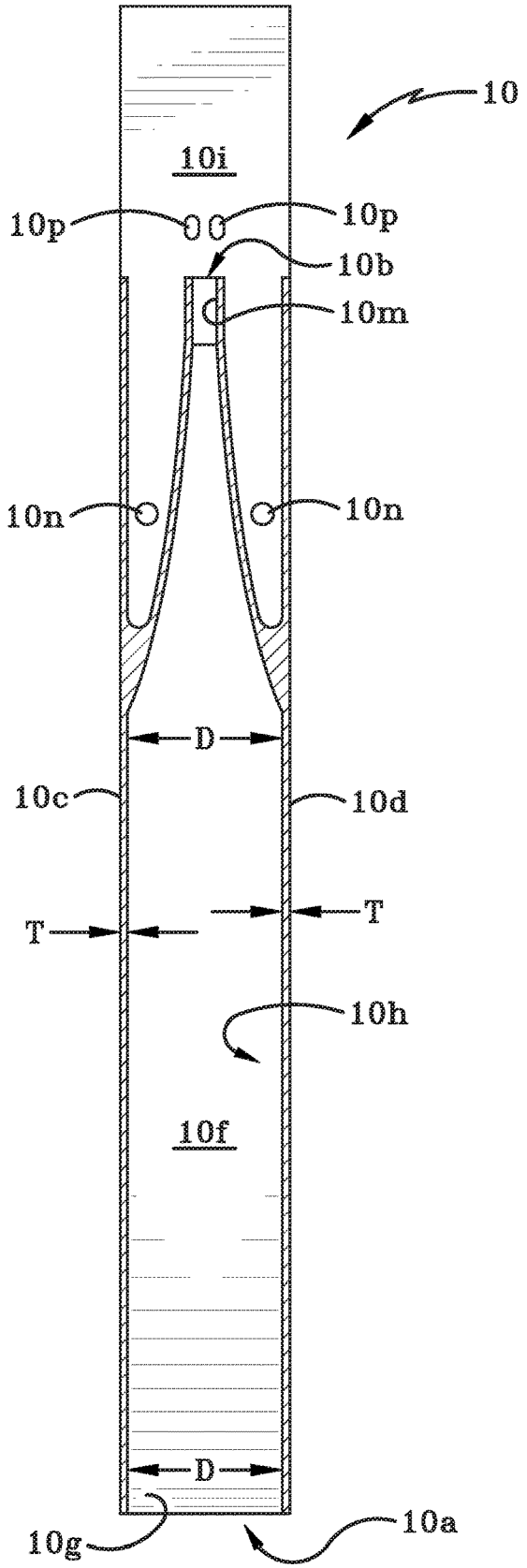
FIG. 4A is a top cross-sectional view of the horn taken along line 4A-4A of FIG. 2.

As shown in FIGS. 2 and 3, an aperture 10*m* is defined at throat 10*b* of horn 10. Aperture 10*m* may be located defined generally centrally in the throat section 10*b* of horn 10 and may be aligned along longitudinal axis "Y". Aperture 10*m* is in fluid communication with interior cavity 10*h* and thereby with opening 10*g*. Opening 10*g* permits sound to enter interior cavity 10*h* and aperture 10*m* permits a microphone to be inserted to receive the sound. The progressively narrowing convex shape of the interior surfaces of top and bottom walls 10*e*, 10*f* and the tapered shape of the interior surfaces of first and second sides 10*c*, 10*d* directs sound that enters opening 10*g* in a rearward direction toward aperture 10*m*. Sound waves are therefore able to enter horn 10 through the opening 10*g* in the mouth 10*a*, move through the interior cavity 10*h* and be focused by the shape of the interior surfaces of walls 10*c*, 10*d*, 10*e*, 10*f* and directed towards the aperture 10*m*.

FIGS. 1-5 also show that an arm 10*i* extends longitudinally and rearwardly from throat 10*b* of horn 10. The arm 10*i* may furthermore extend rearwardly from a portion of bottom wall 10*f*. (In other examples, the arm 10*i* may extend rearwardly from a region of top wall 10*e*.) The purpose of arm 10*i* will be described later herein.

A plurality of flanges 10*j* may be provided at intervals along top wall 10*e* and bottom wall 10*f* at a location adjacent the perimeter of first side 10*c* and the perimeter of second side 10*d*. An exterior region of each flange 10*j* may be flush with the associated one of the first side 10*c* or second side 10*d*. Each flange 10*j* may define an aperture 10*k* therein, where the aperture 10*k* extends between an interior surface and an exterior surface of the associated flange 10*j*. The apertures 10*k* may be oriented generally at right angles to longitudinal axis "Y" of horn 10. The purpose of flanges 10*j* and apertures 10*k* will be described hereafter.

One or more apertures 10*n* (FIG. 1) and apertures 10*p* may be defined in horn 10. Apertures 10*n* may be defined in one or both of top wall 10*e* and bottom wall 10*f* and these apertures 10*n* enable horn 10 to be mounted to a stand 18 as shown in FIG. 6. A portion of stand 18 may extend through apertures 10*n* and appropriate fasteners may be utilized to secure horn 10 and stand 18 together. Apertures 10*p* may be defined in arm 10*i*. A microphone 20 (FIGS. 6 and 7) may be rested on arm 10*i* and may be secured thereto by appropriate fasteners that extend through apertures 10*p*.

The stackable acoustic horn 10 shown in the attached figures has a parametrically decreasing area as viewed from mouth 10*a* of horn 10. The rate of decrease is based on the area of the throat aperture (So) and the lowest frequency of operation of the horn Fc (cutoff frequency).

The area (S) of any plane that is parallel to the mouth aperture 10*g* is given by $$S=S_0*\exp(mx)$$

Where

* is the multiplication symbol x is the distance from the throat to the plane of interest m is proportional to Fc Other mathematical functions can be used to describe the area of each plane in the transition from the mouth 10*a* to the throat 10*b* of the stackable horn 10. These functions include hyperbolic, parabolic, exponential, tractrix, and conical.

For example, the area of the exponentially decreasing horn at a given distance x from the throat is:

$$S(x)=S_0*\exp(mx)$$

The area is also given by:

$$S(x)=H(x)*W(x)$$

where H(x) is the height of the horn and W(x) is the width at a given distance x.

Then:

$$H(x)*W(x)=S_0*\exp(mx)$$

$$H(x)=S_0*\exp(mx)/W(x)$$

$$m=fc*4*\pi/c$$

where fc is the cutoff frequency or lowest operating frequency of the horn and c is the speed of sound.

If the walls of the horn are parallel, the width is fixed and H(x) can be computed and is seen to be an exponential in this case. The minimum height of the horn is the height of the microphone. As a specific example:

$$fc=500\text{ Hz}$$

$$W(x)=5\text{ cm}$$

With a 0.635 cm diameter (radius=0.318 cm) microphone and two parallel walls, the throat area is:

$$S_0=\pi(0.318\text{ cm})^2$$

$$H(x)=\pi*(0.318\text{ cm})^2\exp(500\text{ Hz}/(343\text{ m/s}*4*\pi))/0.05=6.3310^{-4}\exp(18.318*x)\text{ for } x \text{ greater than } 12.58\text{ cm}$$

In this example, the shortest height is the microphone diameter of 0.635 cm which occurs at x=12.58 cm. For x less than 12.58 the height is fixed and above that the height varies. In the region where the height remains fixed, the interior width W(x)) diminishes. The same equation for the area is used except H(x) becomes fixed and W(x) changes with distance:

$$W(x)=S_0*\exp(mx)/H(x)$$

$$W(x)=\pi*(0.318\text{ cm})^2\exp(500\text{ Hz}/(343\text{ m/s}*4*\pi))/0.05=6.3310^{-4}\exp(18.318*x)\text{ for }x\text{ less than }12.58\text{ cm}$$

Figure 6A:
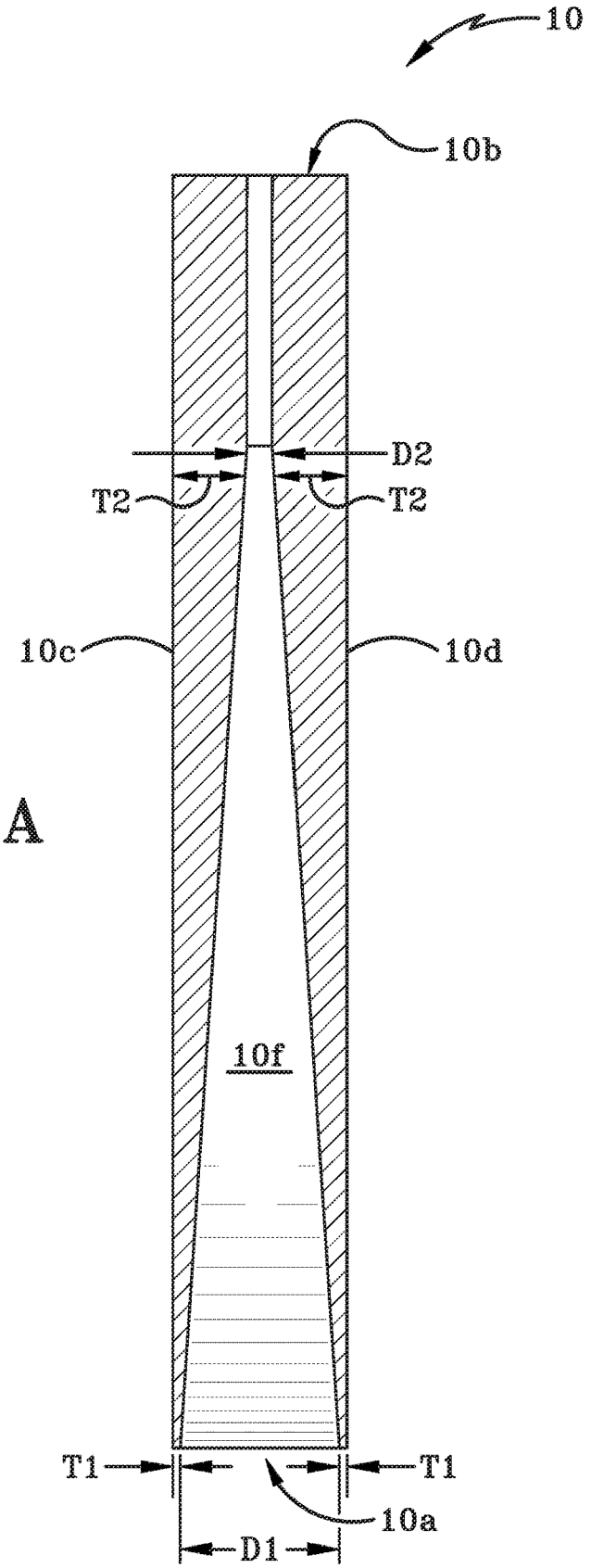
FIG. 6A is a top cross-sectional view of a second exemplary horn similar to the view shown in FIG. 4A, showing the interior surfaces of the first and second sides angling in towards each other and a distance between the interior surfaces diminishing from the mouth to the throat of the horn.

In the stackable horn design, the shape of the first and second sides 10*c*, 10*d* are typically determined first based on spatially aliasing constraints and the desired array shape and configuration. As discussed earlier herein, in FIGS. 1-5, the first and second sides 10*c*, 10*d* are shown to be parallel, flat and of a constant thickness "T" from mouth 10*a* to throat 10*b*. FIG. 6A shows a second exemplary horn 10 where the exterior surfaces of first side 10*c* and second side 10*d* are parallel and flat but the interior surfaces of the first and second sides 10*c*, 10*d* angle inwardly toward each other. In other words, the first side 10*c* and the second side 10*d* are not of constant thickness from the mouth 10*a* to the throat 10*b*. Instead, each of the first and second sides 10*c*, 10*d* is of a thickness "T1" at the mouth 10*a* and of a thickness "T2" at the throat 10*b*, with "T2" being greater than T1"." In this second exemplary horn shown in FIG. 6A, the interior surfaces of the first side 10*c* and second side 10*d* are flat. This configuration results in the distance between the interior surfaces of first side 10*c* and second side 10*d* diminishing from a maximum distance "D1" at the mouth 10*a* to a minimum distance "D2" at the throat 10*b*.

Figure 6B:
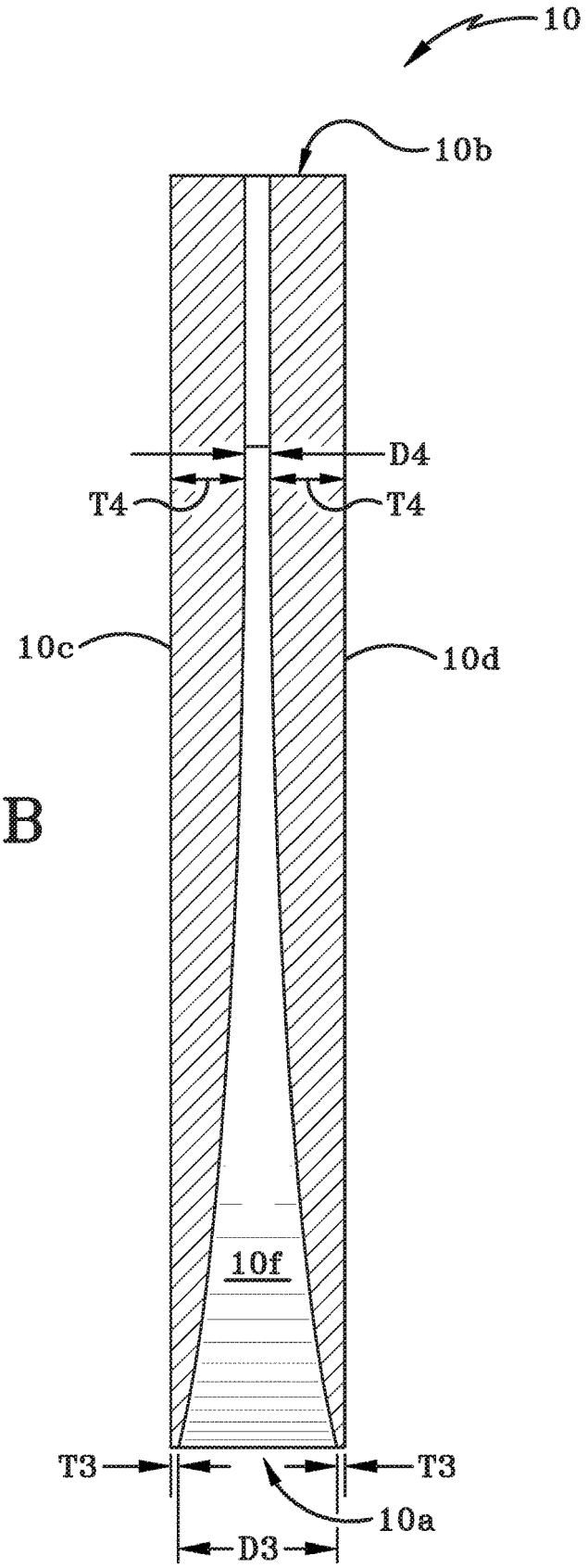
FIG. 6B is a top cross-sectional view of a third exemplary horn similar to the view shown in FIG. 4A, showing curved interior surfaces on the first and second sides and showing a distance between the interior surfaces diminishing from the mouth to the throat of the horn.

A third exemplary horn is shown in FIG. 6B. In this example, the exterior surfaces of first side 10*c* and second side 10*d* are parallel and flat and the interior surfaces of the first and second sides 10*c*, 10*d* angle inwardly toward each other but instead of being flat, the interior surfaces of first and second sides 10*c*, 10*d* are curved. Additionally, the first side 10*c* and the second side 10*d* are not of constant thickness from the mouth 10*a* to the throat 10*b*. Instead, each of the first and second sides 10*c*, 10*d* is of a thickness "T3" at the mouth 10*a* and of a thickness "T4" at the throat 10*b*, with "T4" being greater than "T3". The distance between the interior surfaces of the side walls 10*c*, 10*d* also diminishes from a maximum distance "D3" at the mouth 10*a* to a minimum distance "D4" at the throat 10*b*.

Horns 10 that have parallel first and second sides 10*c*, 10*d* (or at least parallel exterior surfaces of first and second sides 10*c*, 10*d*) may be formed into an array that is generally rectangular or square in shape.

Figure 6C:
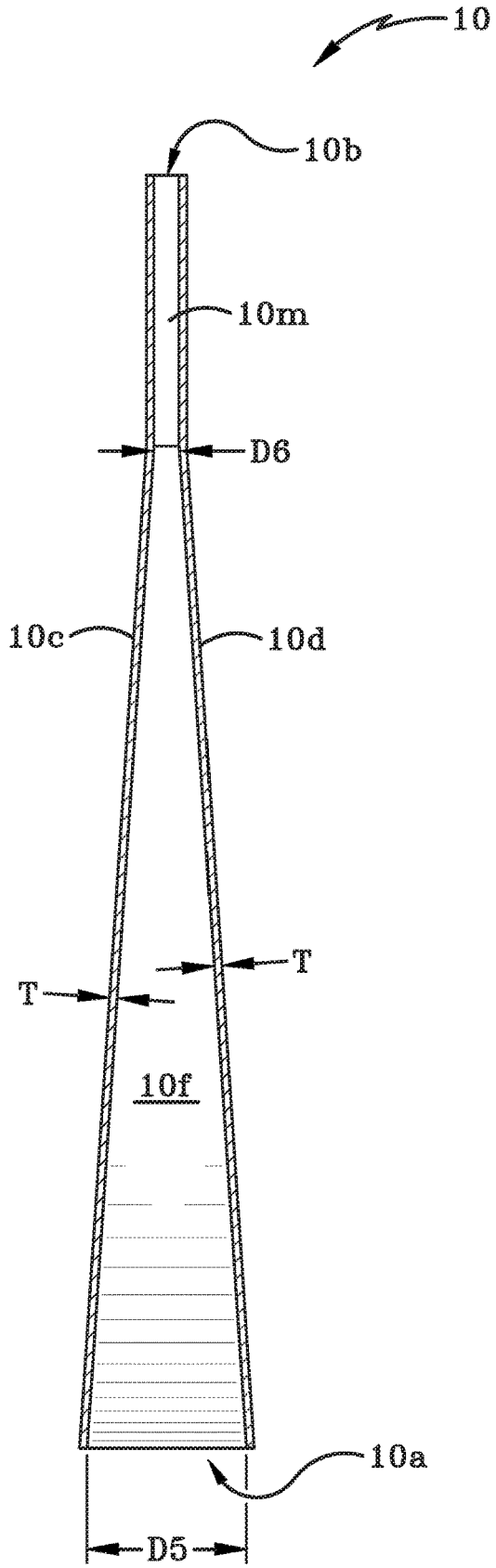
FIG. 6C is a top cross-sectional view of a fourth exemplary horn similar to the view shown in FIG. 4A, showing the first and second sides angling in toward each other and showing the distance between the interior surfaces diminishing from the mouth to the throat of the horn.

The first and second sides 10*c*, 10*d* of horn 10 do not need to be parallel. In a fourth exemplary horn 10, shown in FIG. 6C, the first and second sides 10*c*, 10*d* are flat with a decreasing distance between their interior surfaces moving from mouth 10*a* to throat 10*b*. In other words, the first side 10*c* and second side 10*d* angle inwardly towards each other moving in a direction from mouth 10*a* to throat 10*b* of horn. FIG. 6C shows that the distance between the interior surfaces of first and second sides 10*c*, 10*d* at the mouth 10*a* is a distance "D5" and the distance between the interior surfaces at the throat 10*b* is "D6", with "D5" being greater than "D6". In this example, the thickness "T" of the first side 10*c* and of the second side 10*d* remains constant from mouth 10*a* to throat 10*b*. The configuration illustrated in FIG. 6A would allow a plurality of horns 10 to be configured in a curved or circular array.

Figure 6D:
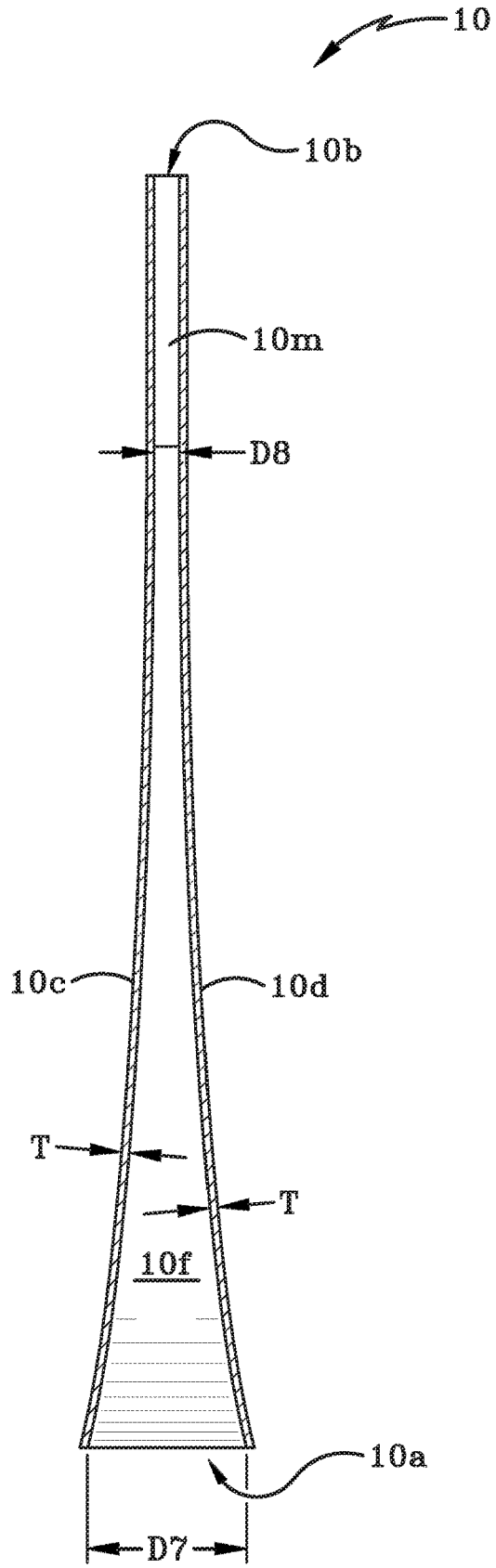
FIG. 6D is a top cross-sectional view of a fifth exemplary horn similar to the view shown in FIG. 4A, showing the first and second sides curving and angling in towards each other and showing the distance between the interior surfaces diminishing from the mouth to the throat of the horn.

The first and second sides 10*c*, 10*d* of horn 10 do not need to be flat. Instead, the first and second sides 10*c*, 10*d* can have a curved shape. FIG. 6D shows an example of a horn that has a curved first side 10*c* and a curved second side 10*d*, where the thicknesses "T" of the first and second sides 10*c*, 10*d* remains constant from mouth 10*a* to throat 10*b*. The distance between the interior surfaces of the first and second sides diminishes from a maximum distance "D7" to a minimum distance "D8".

FIGS. 6A to 6D show that the distance between the interior surfaces of sides 10*c*, 10*d* near the throat 10*b* diminishes while the height remains the same. This occurs over about the last 5 inches of horn 10. Over those 5 inches the exterior walls 10*c*, 10*d* gets thicker.

Figure 7:
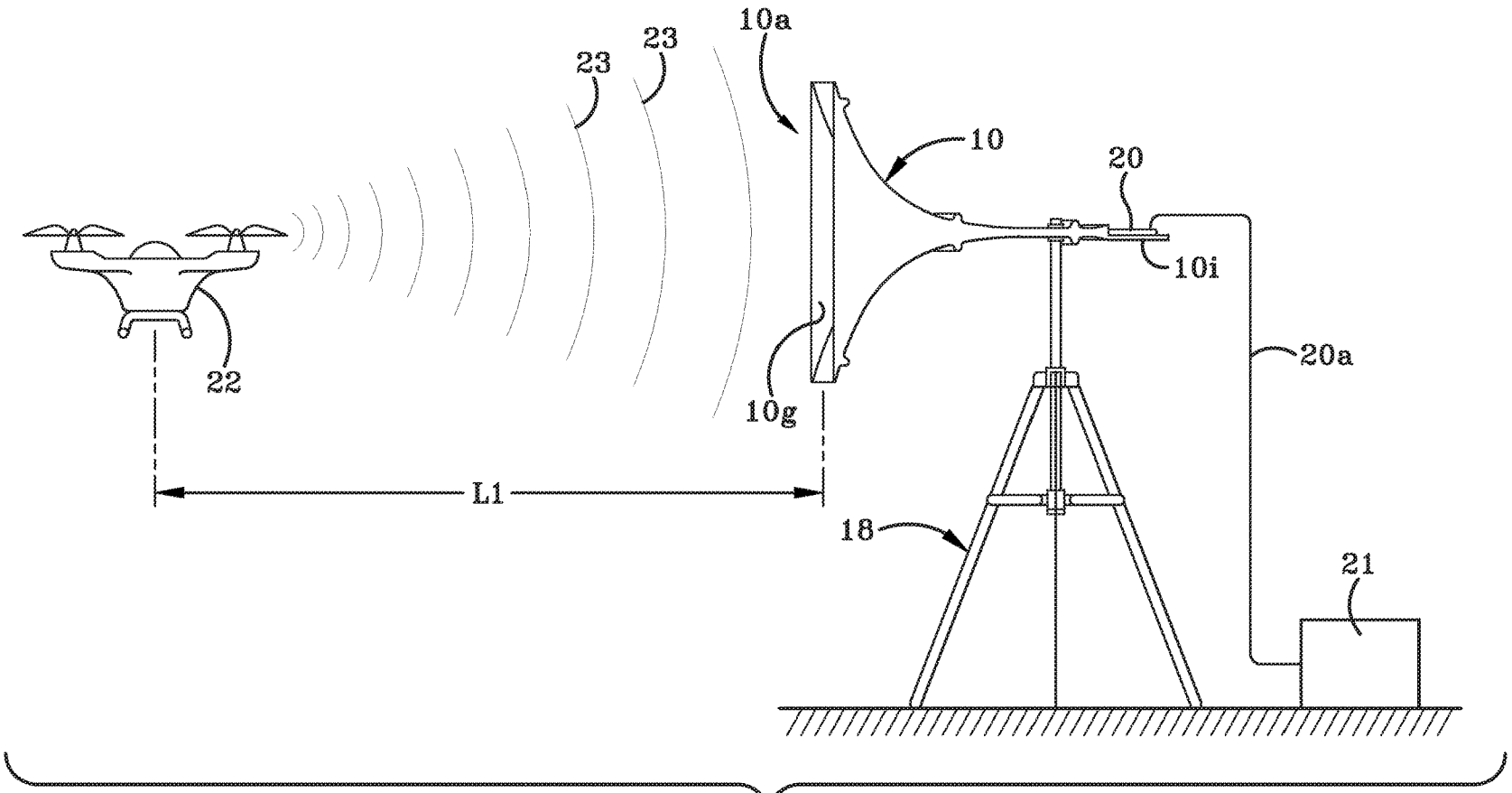
FIG. 7 is a diagrammatic right side elevation view showing the first exemplary stackable acoustic horn of FIGS. 1-5 mounted on a stand and being utilized to listen to a remote Small Unmanned Aerial Vehicle (SUAV).
Figure 8:
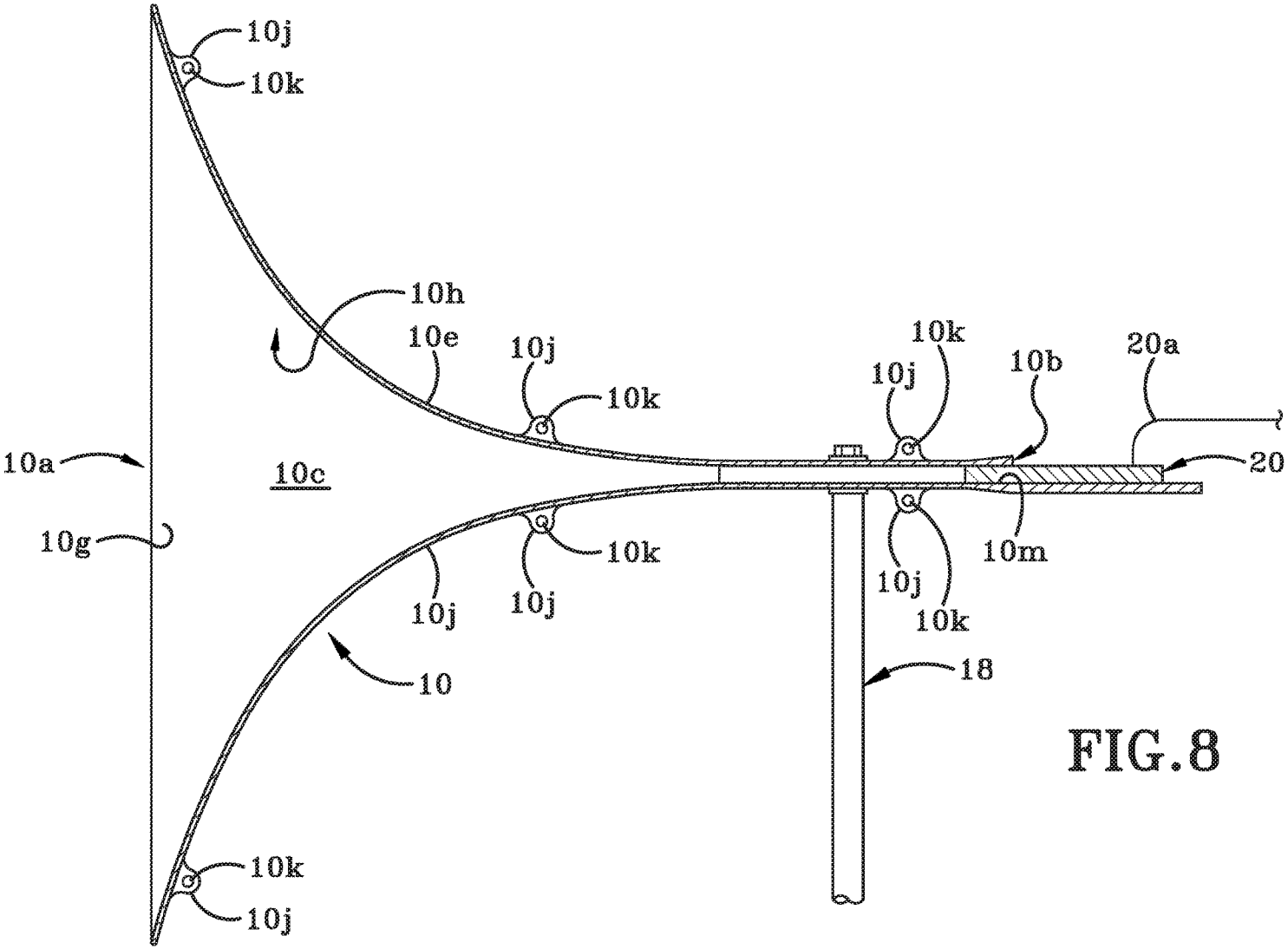
FIG. 8 is an enlarged longitudinal cross-section of the stackable horn shown in FIG. 7, showing the horn mounted on the stand with the microphone inserted into the throat thereof.

FIGS. 7 and 8 show the first exemplary horn 10 (of FIGS. 1-5) mounted on a stand 18 with the horn 10 being oriented in a substantially vertical orientation, i.e., with the top wall 10*e* located vertically above bottom wall 10*f* and with first and second sides being oriented to form a left side and a right side of horn 10. The listening end of a microphone 20 is shown in FIG. 7 to be inserted into aperture 10*m* in order to clearly pick up sound that is focused toward aperture 10*m* by the shape of horn 10. Microphone 20 is inserted into the throat 10*b* of horn 10 and then aperture 10*m* around the body of the microphone 20 is sealed.

Wiring 20*a* extends from microphone 20 to a diagrammatically illustrated device identified by the reference number 21. Device 21 may be any of a number of different pieces of equipment. The particular type of equipment will be dependent on the purpose for which sound is being detected by horn 10. In some instances, device 21 may be a recording device that simply records the sounds "heard" by horn 10. In other instances, device 21 may be a computing device that is programmed with software that will analyze the sounds "heard" by horn 10. The analysis may be performed to identify an object 22 that is located remotely from horn 10. In other instances, device 21 may be a computer that includes or is operatively linked to a remote computing system that is programmed with sound signatures of a plurality of objects. The software in the computer or remote computing system may identify the object 22 based on a comparison of the sound captured by the horn 10 and a database of sound signatures. For example, as illustrated in FIGS. 6 and 7, horn 10 is being utilized to pick up sounds from a remote Unmanned Aerial Vehicle (UAV) 22 that is located a distance "L1" from horn 10. The UAV 22 will generate a sound as it flies through the air. Horn 10 will pick up that sound of the UAV 22 flying through the air and the device will identify the particular type of UAV 22 by comparing the sound detected by the horn 10 with a database of sound signatures for various SUAVs and UAVs. It will be understood that a wide variety of acoustic signal processing may be employed with the stackable horn or an array of stackable horns. These may include detection and/or tracking of vehicles, aircraft, animals, and people.

In other instances, the remote object is not a UAV 22 as illustrated, but is instead a person who is talking. In this instance, device 21 may be a computer or computing system that is programmed to recognize various languages. The device 21 may further be provided with software that will translate from one language into another. The device 21 may further be provided with software that will transcribe conversations that are "heard" by horn 10. It will be understood that a wide variety acoustic signal processing may be employed with the stackable horn or an array of stackable horns. These may include speech processing, including speech transcription, automatic speech recognition, language translation, separation of speech from multiple speakers, echo cancellation, voice activity detection, and noise reduction. It will be understood that a wide variety of other devices 21 that process, record, and analyze sound may be operatively engaged with stackable acoustic horn 10. It will further be understood that instead of wiring 20*a* being utilized, the horn 10 may be wirelessly connected to device 21. Device 21 may furthermore be located remote from horn 10, and may be located on a person, in or on a building, or in or on a vehicle such as a car, truck, aircraft, UAV, train, satellite, or ship.

It should be noted that horn 10 is capable of reliably detecting sounds from a distance that is approximately ten times greater than the distance that the microphone 20 on its own is able to reliably detect. If a comparison is made between a regular half inch microphone and a single horn 10 in combination with a half inch microphone 20, the combination device 10, 20 is capable of gathering sound at a distance "L1" that is about ten times greater than the single microphone on its own. So, if the microphone 20 on its own is able to detect sounds from 10 feet away, the horn 10 will be capable of detecting sound from a distance "L1" of about 100 feet away.

Figure 9:
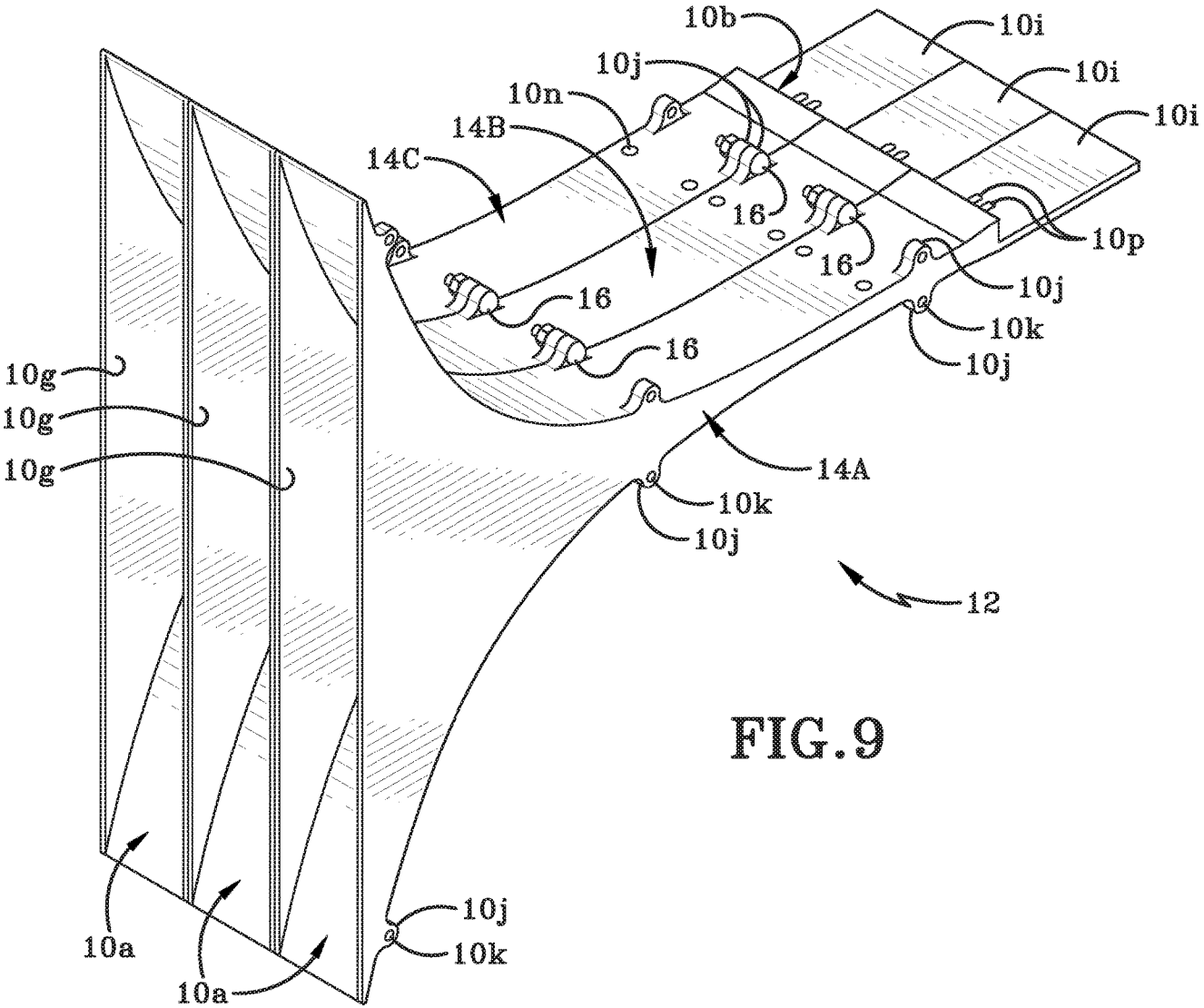
FIG. 9 is an isometric perspective view of a first exemplary array of stackable acoustic horns in accordance with the present disclosure, where the sides of adjacent horns are placed in abutting contact with each other.
Figure 10:
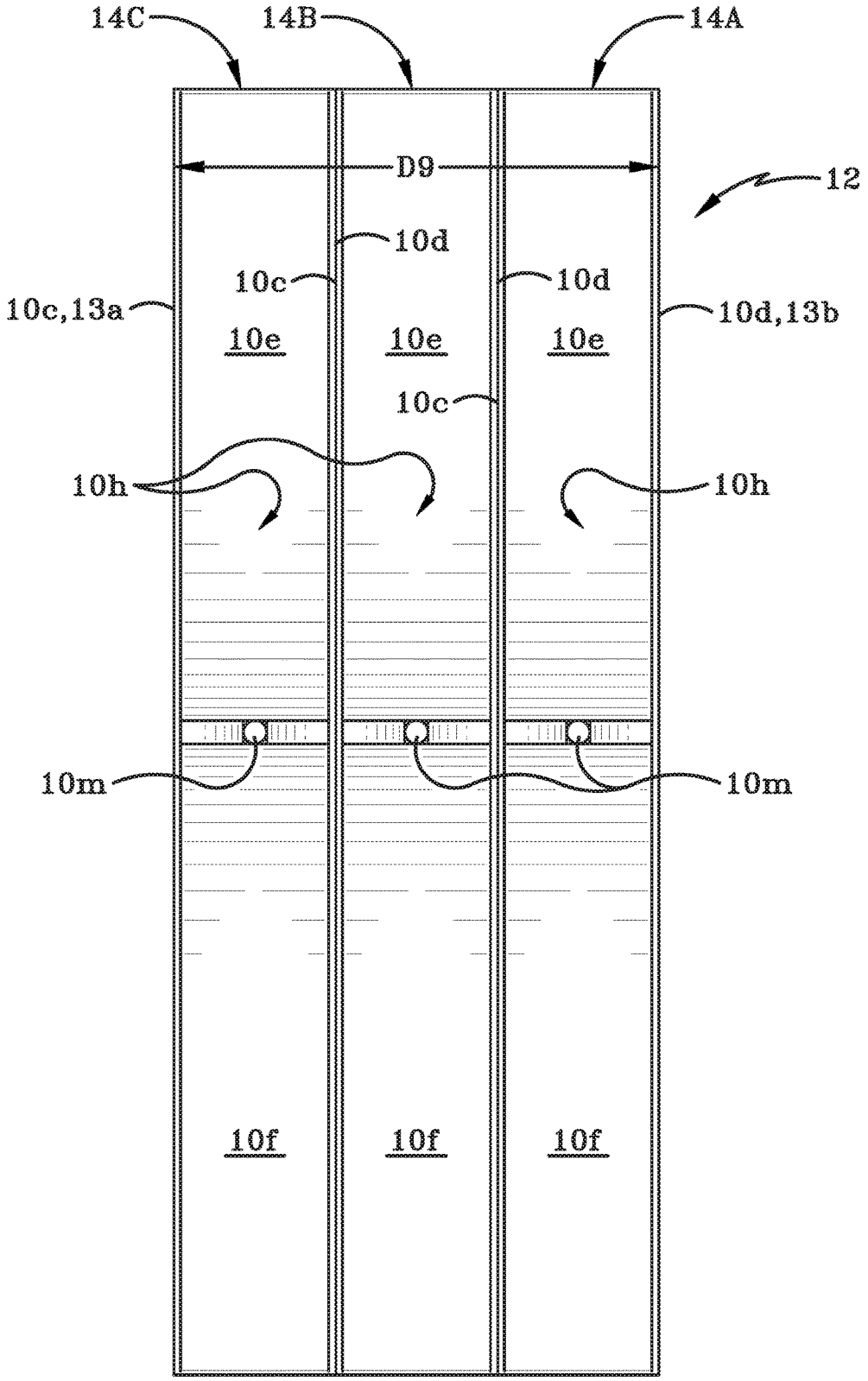
FIG. 10 is a front elevation view of the array of FIG. 9.
Figure 11:
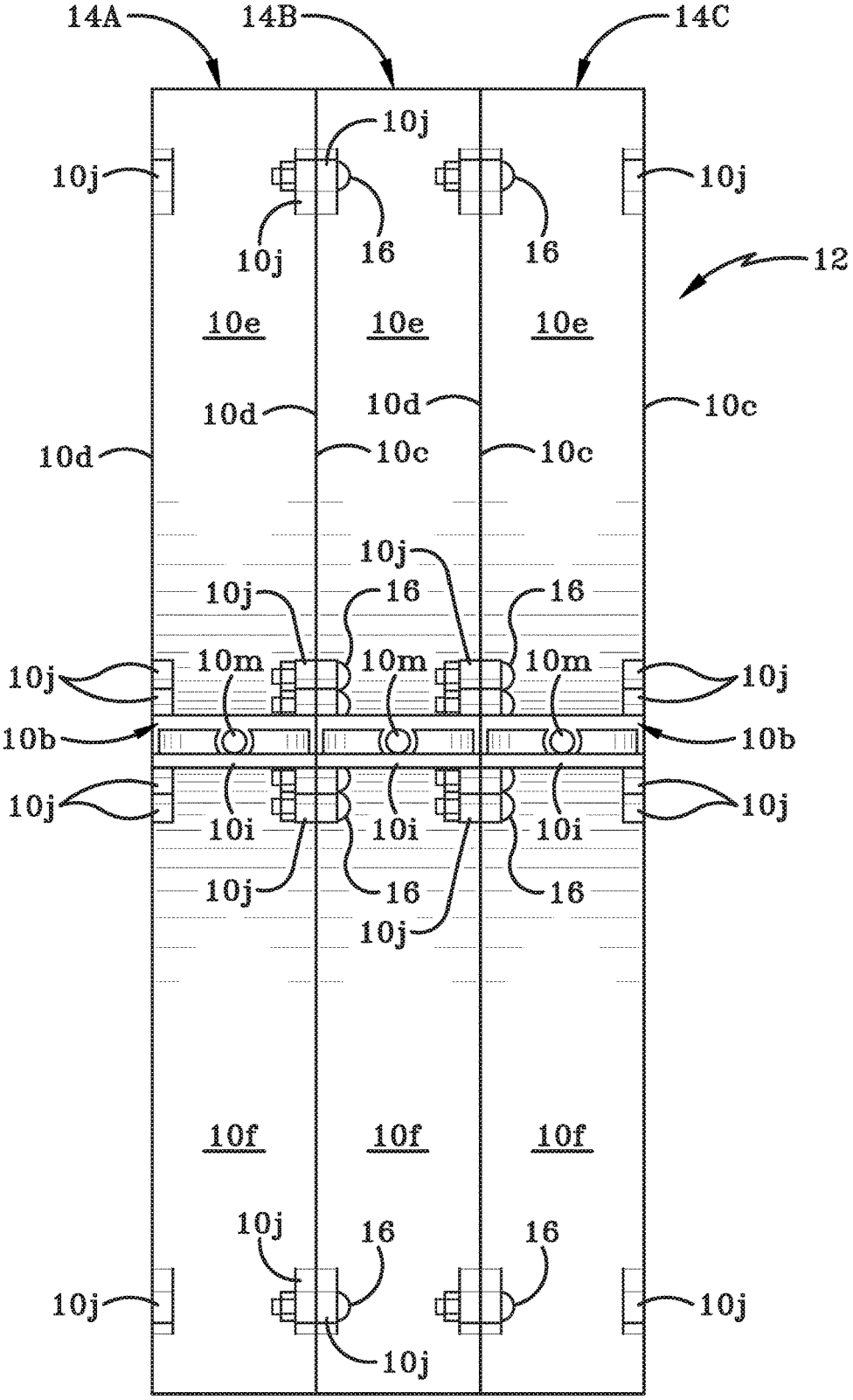
FIG. 11 is a rear elevation view of the array of FIG. 9.
Figure 12:
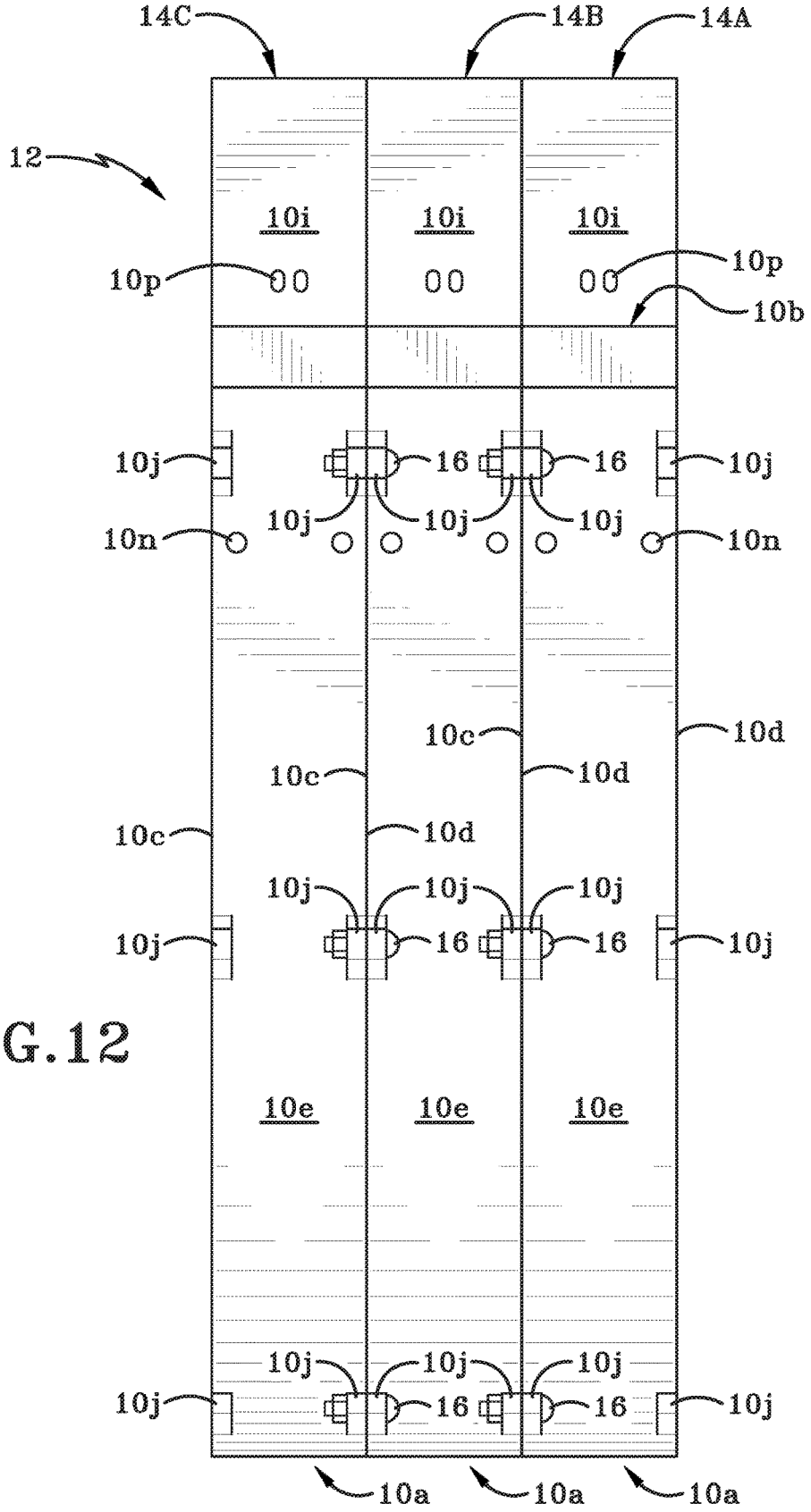
FIG. 12 is a top plan view of the array of FIG. 9; the unshown bottom plan view being a mirror image thereof.

Referring now to FIGS. 9-13, there is shown an array 12 formed by stacking a plurality of stackable acoustic horns together. Each horn in array 12 may be substantially identical to the horn 10 shown in FIGS. 1-5. FIGS. 9-13 show three horns but it will be understood that array 12 may include any desired number of horns therein. In array 12 a first horn is indicated by the reference number 14A, a second horn is indicated by the reference number 14B, and a third horn is indicated by the reference number 14C. In the array 12, horns 14A, 14B, 14C are all oriented in an identical manner with their mouths 10*a* at a leading end of the array 12 and with their throats 10*b* at a trailing end of the array 12. Additionally, all three horns 14A, 14B, 14C are aligned with each other, i.e., the top walls thereof are all aligned with each other and the bottom walls thereof are all aligned with each other. Furthermore, as shown in FIG. 9, horns 14A and 14B are positioned such that there is abutting contact between the second side 10*d* of horn 14B and the first side 10*c* of horn 14A. Horns 14B and 14C are positioned such that there is abutting contact between the second side 10*d* of horn 14C and the first side 10*c* of horn 14B. Horn 14B is thus sandwiched between horns 14A and 14C.

Array 12 is therefore configured such that the top walls 10*e* of all of the horns 14A, 14B, 14C forms a collective top wall of the array 12 and the bottom walls 10*f* of all of the horns forms a collective bottom wall of the array 12. The first side 10*c* of horn 14C forms a left side of the array 12 and the second side 10*d* of horn 14A forms a right side of the array 12. Additionally, the mouths 10*a*, the throats 10*b*, and the perimeters of the first and second sides 10*c*, 10*d* of all of the plurality of horns 14A, 14B, and 14C are in alignment with each other. Array 12 may therefore be generally rectangular in shape when viewed from the front (i.e., facing the mouths 10*a* of the horns 10.

Flanges 10*j* and associated apertures 10*k* on the adjacent horns 14A, 14B, and 14B, 14C are aligned with each other and a fastener 16 may be passed through each pair of aligned apertures 10*k* to secure adjacent horns to each other. In other examples, a single fastener may be passed through a series of aligned apertures 10*k* to secure multiple horns to each other. Alternatively, the aligned horns may be integrally formed as a unitary, monolithic member that effectuates a similar resultant configuration.

Figure 13:
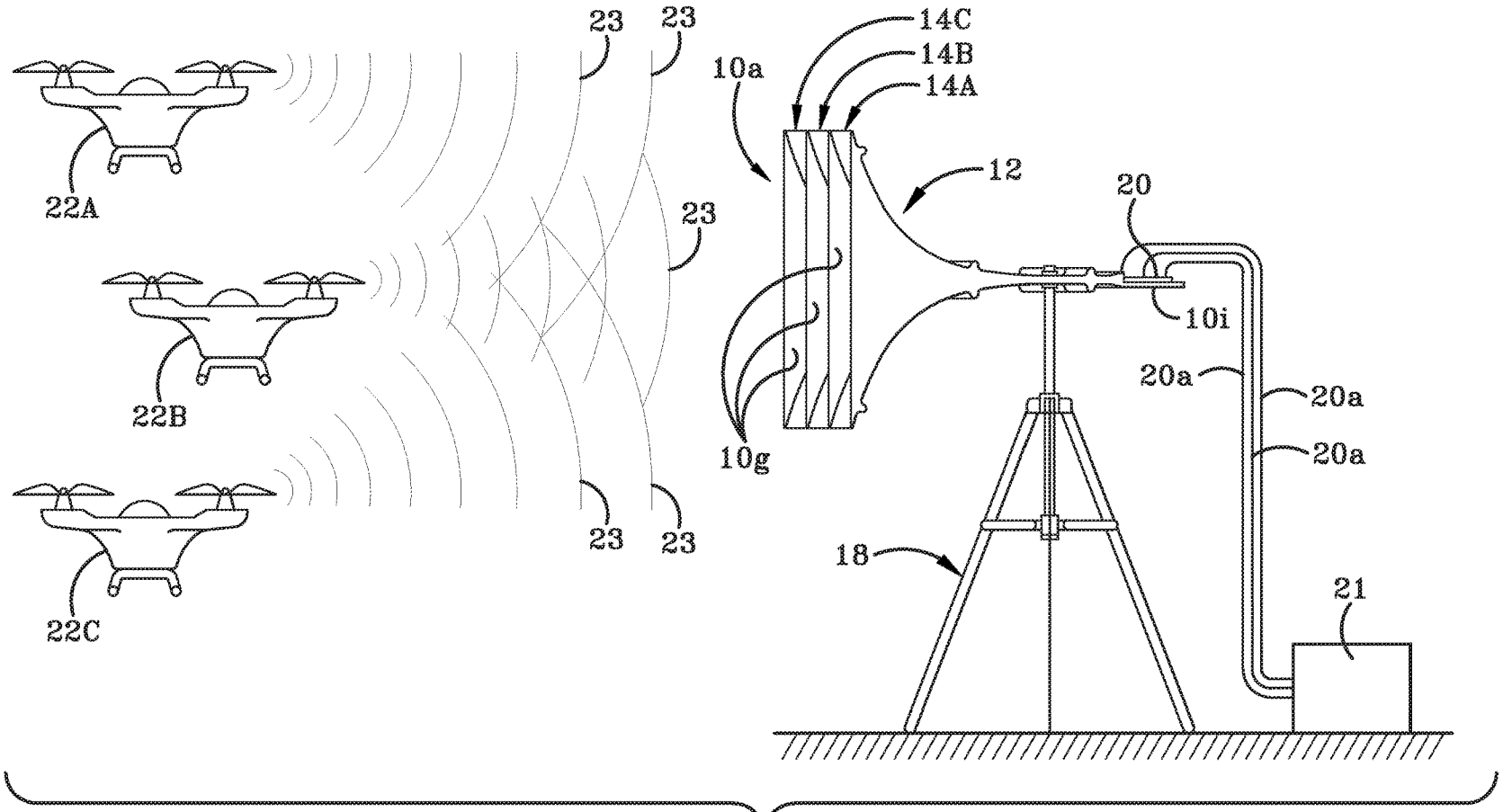
FIG. 13 is a diagrammatic right side elevation view of the array of FIG. 9 being used to simultaneously, listen to, track, and identify multiple SUAVs a remote distance from the array.

FIG. 13 shows array 12 mounted on a suitable stand 18. Some or all of the apertures 10*n* in the horns 14A, 14B, and 14C may receive portions of the stand 18 therethrough or may receive fasteners therethrough that will secure array 12 to stand 18. Each horn 14A, 14B, 14C has its own mouth 10*g* at the mouth 10*a* of the horn, and its own aperture 10*m* located at the throat 10*b* thereof. It will be understood (although not illustrated herein) that each horn 14A, 14B, 14C will have its own microphone 20. Each microphone 20 is inserted into the associated aperture 10*m* so that it may receive focused sound from the associated respective horn 14A, 14B, and 14C. Each horn 14A, 14B, 14C is therefore capable of individually and independently hearing sounds from a remote object but it should be understood that although the microphones collect sound independently, the sound is highly correlated from horn to horn.

Wiring 20*a* may extend between each individual microphone 20 and a device 21 as discussed earlier herein. Further alternatively, the wires could be eliminated and a wireless transmission could be used to transmit the observed signals from microphone 20 to device 21 for processing via various acoustic processing logic. It will be understood that multiple devices 21 may be provided instead of a single device 21.

Stackable acoustic horn 10 is designed for use as a single stackable acoustic horn 10 or as one of a plurality of horns 10 that are configured into array 12. The distance between the sides 10*c*, 10*f*, and hence the width of aperture 10*g* is determined by the designer. Once the width of aperture 10*g* is known or decided, then the height of horn 10 can be determined from the given area equation. Alternatively, if the height of horn 10 is fixed, the width of aperture 10*g* can be determined by a design equation. One constraint that is considered when configuring array 12 is the desired spacing of the microphones 20 used in a plurality of horns 10, such as will be described below. Microphones 20 that are more closely spaced allow the array to operate at higher frequencies without spatial aliasing.

For example, for a given frequency with wavelength λ, aliasing will be avoided if the array microphone spacing $d<\lambda/2$. This is not dependent on the number of microphones with a speed of sound of $v$=343 m/s $d$=0.05$m$=5 cm Lambda=0.1 m then frequency=$v$/Lambda=343 m/s/0.1=3430 Hz As long as the array 12 is operated below 3430 Hz there will be no spatial aliasing. Above 3430 Hz, aliasing can occur.

It may be noted that the width of the horn may be less than d listed above. Therefore, an array 12 might have horns 10 that are each 2.5 cm in width, but that are then spaced 5 cm apart. This might be done to allow a second array to be interleaved with the first array. Each of the arrays may be pointed in a different direction.

As indicated earlier herein, a plurality of stackable acoustic horns 10 are stacked side-by side to form array 12. In array 12, a distance "D9" (FIG. 10) extends from a first side surface 13*a* of array 12 to a second side surface 13*b* of array 12. As illustrated, the first side surface 13*a* is first side 10*c* of horn 14C and the second side surface 13*b* is second side 10*b* of horn 14A. The first side surface 10*c* of each of the plurality of stackable acoustic horns the array 12 is spaced a distance away from a second side surface 10*d* of each of the plurality of stackable acoustic horns in the array 12. This distance is selected to be sufficiently narrow enough to allow the plurality of stackable acoustic horns 14A, 14B, 14C to be arranged in the array 12 in a configuration that permits a beamforming function to be performed without spatial aliasing. The configuration of array 12 makes it possible for beamforming to be utilized to enhance location and tracking of a plurality of objects 22A, 22B, 22C with the horns 14A, 14B, and 14C gathering sound from the objects. The horns in an array do not operate as separate entities pointed in different directions. Instead, their beams overlap almost entirely. Each horn 14A, 14B, 14C gathers sound over a width of from about 140 up to about 160 degrees and a height of from about 25 up to about 35 degrees. The particular width and height depends on the exact design of the horn. Sound waves coming from anywhere in that beam and from a reasonable distance will be approximately a plane wave, which will impinge upon the array 12.

Depending upon the angle of the source of the sound, the plane wave will arrive at each horn mouth at slightly delayed times and can be processed to account for the delay. This processing is the essential element of beam forming. From a long distance (far field), each of the horn beams approximately covers the same volume. Imagine two sprinklers placed one inch apart that spray water over a diameter of 100 ft. They essentially cover the same ground. The horns are analogous to the sprinklers, only the water would be going in the opposite direction.

The horns in array 12 tend to point to and cover essentially the same area. It is only after beamforming that the sound from different sound producing objects can be separated. Beamforming based on the arrangement of the array 12 improves the ability of the system to detect, track, and identify a plurality of different objects simultaneously. The configuration of array 12 also tends to reduce spatial aliasing constraints with respect to beamforming because horns 14A, 14B, and 14C are closely physically associated with each other. Electronic/digital beamforming made possible by the physical structure of horns 14A, 14B, 14C and array 12 provides for simultaneous focus of the array 12 on multiple distant and separate targets of interest. Furthermore, the acoustic array 12 is capable of operating under difficult weather conditions and this results in a significantly improved capability for listening operations for organizations such as the military.

Array 12 therefore provides a great advantage over previously known acoustic devices such as parabolic microphones that are only capable of listening in a single direction. The horn 10 and array 12 in accordance with the present disclosure therefore provides high acoustic gain (i.e., an increase in the amplitude or level of a signal), and when used as the array 12, enables beamforming. Other high gain directional microphones (e.g. parabolic dish, shotgun) cannot be used in an array.

By way of example, an array that includes twenty-four horns 10 with associated microphones 20 is capable of detecting objects 22A, 22B, and 22C (FIG. 13) at a listening distance of about fifty times greater than a single microphone on its own. So, for example, if one microphone 20 can detect sound at 19.7 feet (6 m), the array 12 with twenty-four horns has been found to reliably detect sounds at about 985 feet (about 300 m). Utilizing the array 12 thus substantially increases the listening distance that is possible between microphones 20 and a remote object 22A, 22B, or 22C.

It is contemplated that the horn 10 and array 12 disclosed herein may be used in a variety of settings, including but not limited to listening to people at long distances including at sporting events, detection of vehicles, people speaking, firing of firearms and other munitions, as well as detection, identification and tracking of Unmanned Aerial Systems (UAS) or Unmanned Aerial Vehicles (UAVs) or other vehicles, regardless of whether they are manned or unmanned, or on the ground or in the air, or possible even below ground or below water.

Figure 14:
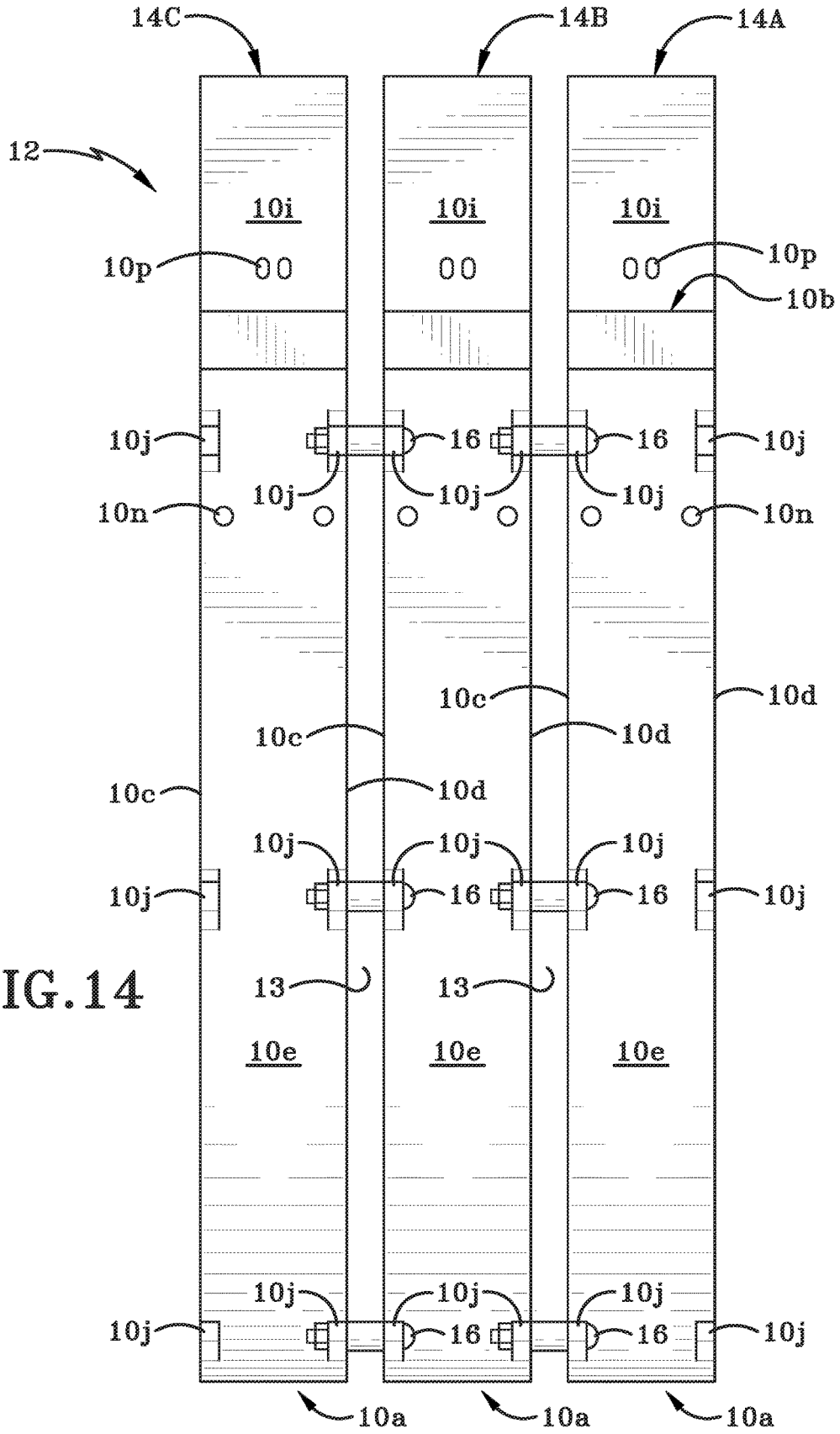
FIG. 14 is a rear elevation view of a second exemplary array of stackable acoustic horns in accordance with the present disclosure, where the first and second sides of adjacent horns are spaced laterally a distance apart from each other.

As shown in FIG. 14, the horns 14A, 14B, 14C that are configured into an array 12 need not be butted together. In other words, the first side 10*c* of a first horn does not need to be placed in abutting contact with the second side 10*d* of a second horn. Instead, adjacent horns in the array may be spaced laterally apart from each other. FIG. 14 shows horns 14A and 14B separated from each other by a gap 13 and horns 14B and 14C being separated from each other by a gap 13. Horns 14A, 14B, 14C may be spaced apart as long as the spacing of each mouth aperture 10*g* meets the spatial aliasing operational needs.

While FIGS. 9-14 show stackable acoustic horns 10 arranged in a generally rectangular array, horns 10 may be stacked or aligned in other orientations. For example, the horns may be configured to make a curved array, such as the array 12A shown in FIG. 15. In this second exemplary array 12A, five stackable acoustic horns are utilized, namely horns 14A, 14B, 14C, 14D, and 14E. The top walls 10*e* of adjacent horns 14A, 14B, 14C, 14E, and 14F are offset relative to each other. It will be understood that additional horns may be incorporated into array 12A to form a curved or circular array. The configuration illustrated in FIG. 15 would result in narrow/tall beams pointing in different directions.

Figure 15:
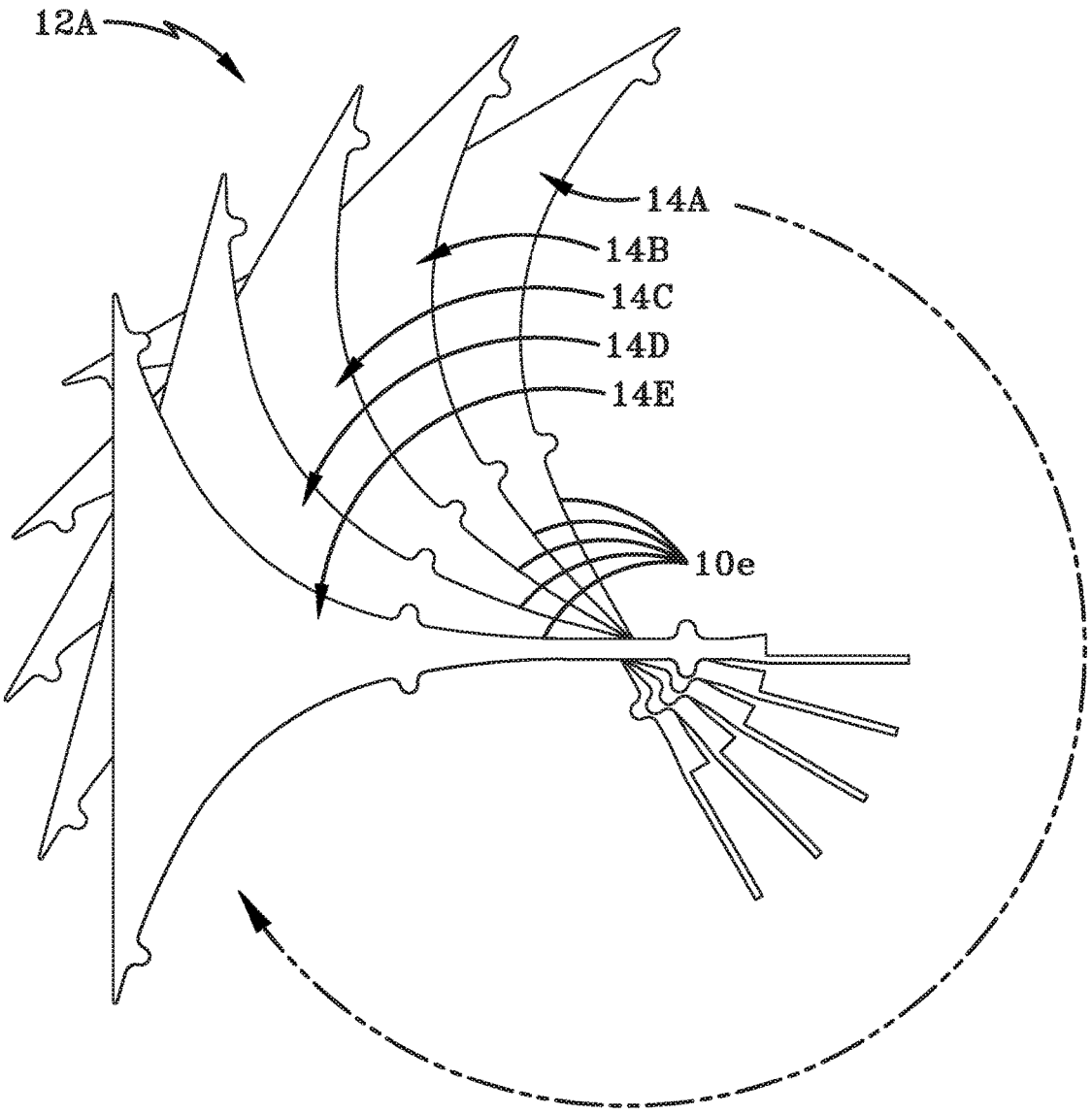
FIG. 15 is a top plan view of a third exemplary array of stackable acoustic horns in accordance with the present disclosure, wherein the top walls of adjacent stackable acoustic horns are offset relative to each other and the array is spiraled.

It will be understood that a curved or circular array may be differently formed from what is illustrated in FIG. 15 by utilizing the horns shown in FIG. 6C or 6D. These horns that have tapering first and second sides may be placed side-by-side with their top walls 10*e* being positioned in alignment with each other. A first side 10*c* of a first horn may be placed proximate a second side of a second horn that is similarly configured. The first and second sides 10*c*, 10*d* of the adjacent horns may be placed in abutting contact with each other or may be spaced laterally from each other.

It will be understood that a wide variety of differently shaped arrays may be formed utilizing the stackable acoustic horns disclosed herein.

Figure 16:
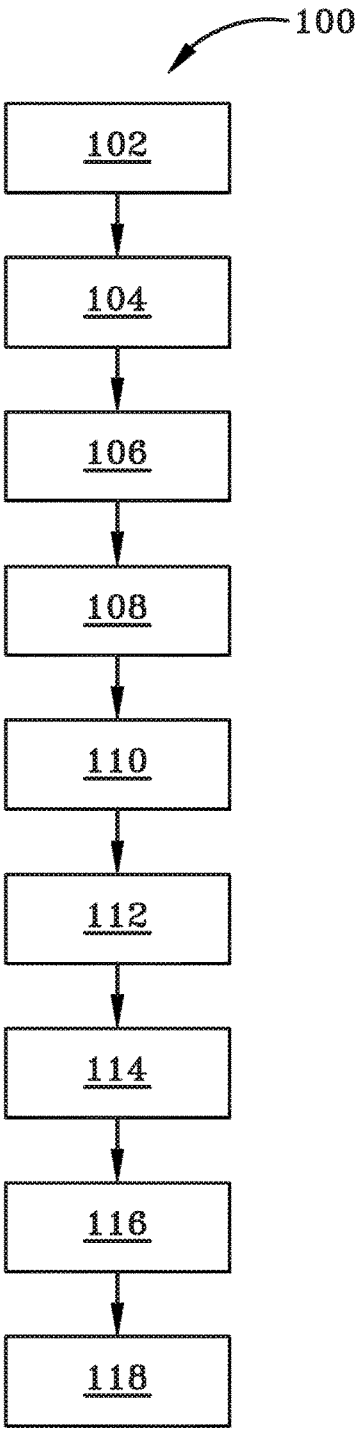
FIG. 16 is a flowchart illustrating a method of locating, tracking and/or identifying objects utilizing sound and an array of stackable acoustic horns.

FIG. 16 is a flowchart showing a method of locating, tracking and/or identifying objects utilizing sound, generally indicated at 100. The method includes a first step 102 comprising providing a plurality of horns that each have a substantially planar first side and a substantially planar second side. In a second step 104, the plurality of horns are arranged in an array so that the first side of a first one of the plurality of horns is in abutting contact with the second side of a second one of the plurality of horns. In a third step 106, sound is generated by at least one remote object or person. In a fourth step 108, the generated sound is gathered utilizing the horns in the array. The method may further comprise a fifth step 110 of directing the gathered sound rearwardly toward a microphone provided at a rearward end of each horn in the array. The method may further comprise a sixth step 112 of operatively engaging each of the microphones with a device. In a seventh step 114, the device is programmed with software that causes the device to locate, track, and/or identify remote objects. In an eighth step 116, the method may further comprise performing a beamforming operation utilizing the array. In a ninth step 118, the remote objects that are generating noise are one or more of located, tracked, and identified.

Figure 17:
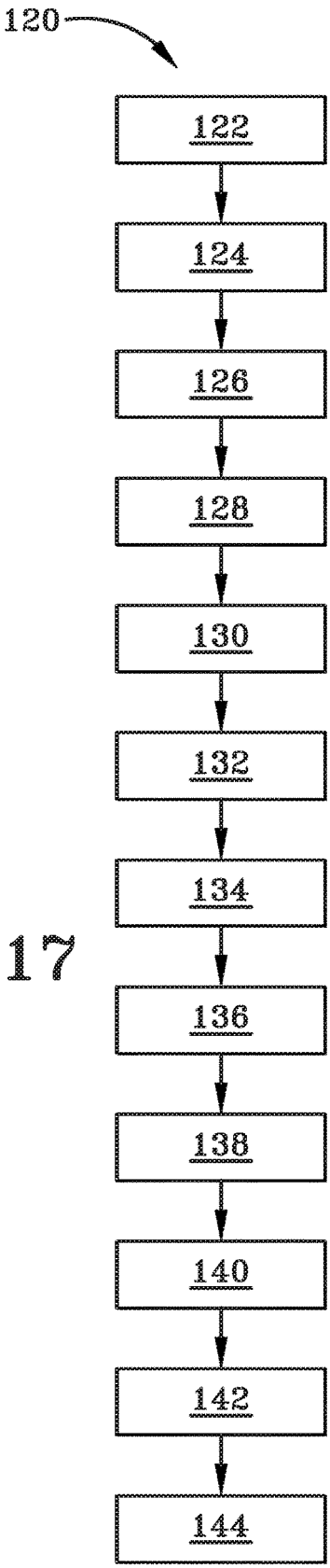
FIG. 17 is a flowchart illustrating another method of locating and tracking a remote object that generates sound utilizing an array of stackable acoustic horns.
Figure 18:
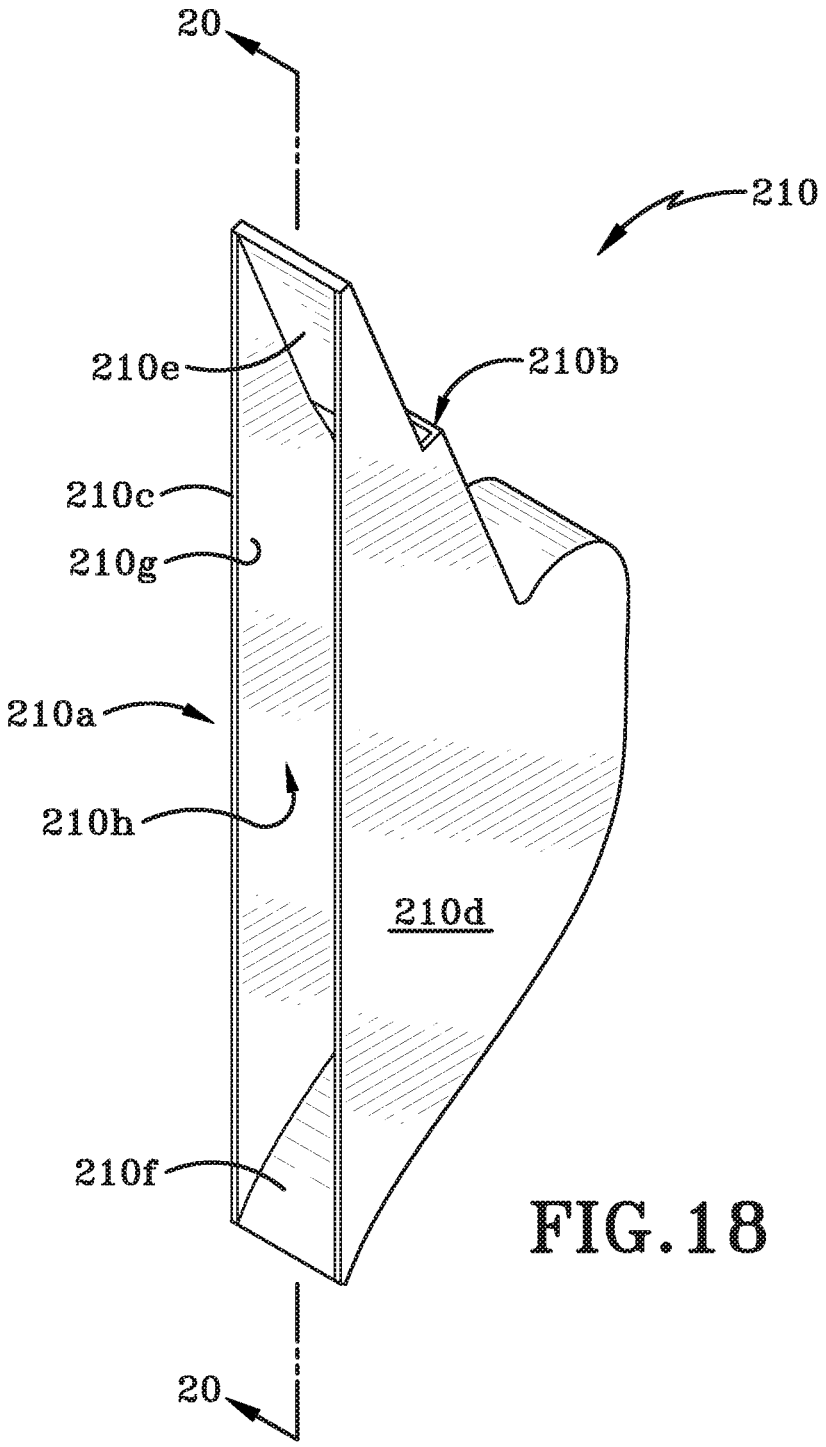
FIG. 18 is an isometric perspective view of a sixth exemplary embodiment of a stackable acoustic horn in accordance with the present disclosure, where the sixth exemplary embodiment comprises a folded stackable acoustic horn.

FIG. 17 is a flowchart illustrating a method of locating and tracking a remote object that generates sound generally indicated at 120. Method 120 includes a first step 122 of receiving sound generated by a remote object into a mouth of a stackable acoustic horn. In a second step 124, the received sound is directed inwardly toward an aperture provided at a throat of the stackable acoustic horn. A third step 126 involves narrowing an interior cavity of the stackable acoustic horn from the mouth thereof to the throat thereof. A fourth step 128 involves focusing the directed sound at the throat of the stackable acoustic horn. A fifth step 130 may comprise placing a microphone at the throat of the stackable acoustic horn. A sixth step 132 involves receiving the focused sound into the microphone. A seventh step 134 includes comparing a known acoustic signature (or its characteristics) for a class of objects with the inputted sound, i.e., the sound focused into the microphone. An eighth step 136 is the identification of the remote object based on the comparison. A ninth step 138 of method 120 may comprise positioning the stackable acoustic horn at a distance away from the remote object; wherein the distance is around five, or even up to ten or more, times a distance of detecting the sound generated by the remote object if using the microphone on its own. The method 120 may further comprise a tenth step 140 of forming an array of a plurality of stackable acoustic horns which involves an eleventh step 142 of stacking adjacent stackable acoustic horns in the array side-by-side. In a twelfth step 144, a first remote object is located and tracked object using a first beam developed by beamforming processing sound gathered with an array of stackable acoustic horns and a second remote object is simultaneously located and tracked using a second beam developed by beamforming processing sound gathered using the same array.

A stackable acoustic horn in accordance with the present disclosure does not need to be symmetrical about a "Y" axis as shown in FIG. 7. Instead, the stackable acoustic horn may be bent or folded to form a folded stackable acoustic horn as shown FIGS. 18-21 and generally indicated herein by the reference number 210. The folded horn uses essentially the same design principles as the straight horn disclosed above. In the folded stackable acoustic horn the entire rear projecting part of the horn can be folded back onto itself. The folding method and constraints are the same as would be used with a loud speaker. Although the folded stackable acoustic horn 210 is shown in a particular orientation in FIGS. 18-21, it will be understood that horn 210 may be used in other orientations such as rotated through 180° relative to the way horn 210 is illustrated in these figures. The purpose of the folded horn is to minimize the depth of the overall structure.

Folded stackable acoustic horn 210 has a mouth 210*a*, a throat 210*b*, and comprises a first side 210*c*, a second side 210*d*, a top wall 210*e*, and a bottom wall 210*f*. First side 210*c*, second side 210*d*, top wall 210*e*, and bottom wall 210*f* bound and define an interior cavity 210*h* that has an opening 210*g* at mouth 210*a* and an aperture 210*m* defined at throat 210*b*. Opening 210*g*, interior cavity 210*h*, and aperture 210*m* are in fluid communication with each other. As indicated above, in the folded stackable acoustic horn 210 part or all of the rearwardly projecting part of the horn (i.e., rearwardly of mouth 210*a*) can be folded back onto itself. In one example, top wall 210*e* may be folded inwardly toward bottom wall 210*f*. In another example, bottom wall 210*f* may be folded inwardly toward top wall 210*e*. In yet another example, some or all of top wall 210*e* and some or all of bottom wall 210*f* may be folded inwardly toward each other. In yet another example, some or all of top wall 210*e* or some or all of bottom wall 210*f* may be folded inwardly and forwardly toward mouth 210*a*. In yet other examples, portions of one of first side 210*c* and second side 210*d* may be folded inwardly to the other of first side 210*c* and second side 210*d*. It will be understood that this folding may occur more than once on the at least one stackable acoustic horn.

Sound enters horn 210 through the opening 210*g* in mouth 210*a* and is focused by the interior surfaces of first side 210*c*, second side 210*d*, top wall 210*e*, and bottom wall 210*f* towards aperture 210*m*. A microphone may be inserted into aperture 210*m* in a similar fashion to the way microphone 20 is inserted into aperture 10*m* or is carried in horn 10. Putting the microphone in the particular location that is illustrated in the figures allows the long part of the folded horn structure to fit up against the tall part of the horn. This arrangement significantly reduces the depth of the horn.

Folded stackable acoustic horn 210 may be used in a similar or identical manner and for a similar or identical purpose as stackable acoustic horn 210.

First side 210*c* and second side 210*d* in horn 210 may be substantially identically configured, may be opposed, and substantially parallel to each other. First side 210*c* and second side 210*d* may be flat and a gap may be defined between them. The first side 210*c* and second side 210*d* may be of a constant distance "D" (FIG. 21) apart from each other. First and second sides 210*c*, 210*d* are aligned along their outer perimeters relative to each other.

In other examples, not illustrated herein, first side 210*c* and second side 210*d* may angle inwardly toward each other from mouth 210*a* towards throat 210*b* instead of being parallel to each other. This angling may be accomplished by orienting the entire wall at an angle or by changing the thickness of the sides 210*c*, 210*d* so that the sides become thicker from the mouth 210*a* and towards the throat 210*b*. As with stackable horn 10, the configuration of folded stackable acoustic horn 210 may be specifically designed by a designer for a desired purpose.

Figure 19:
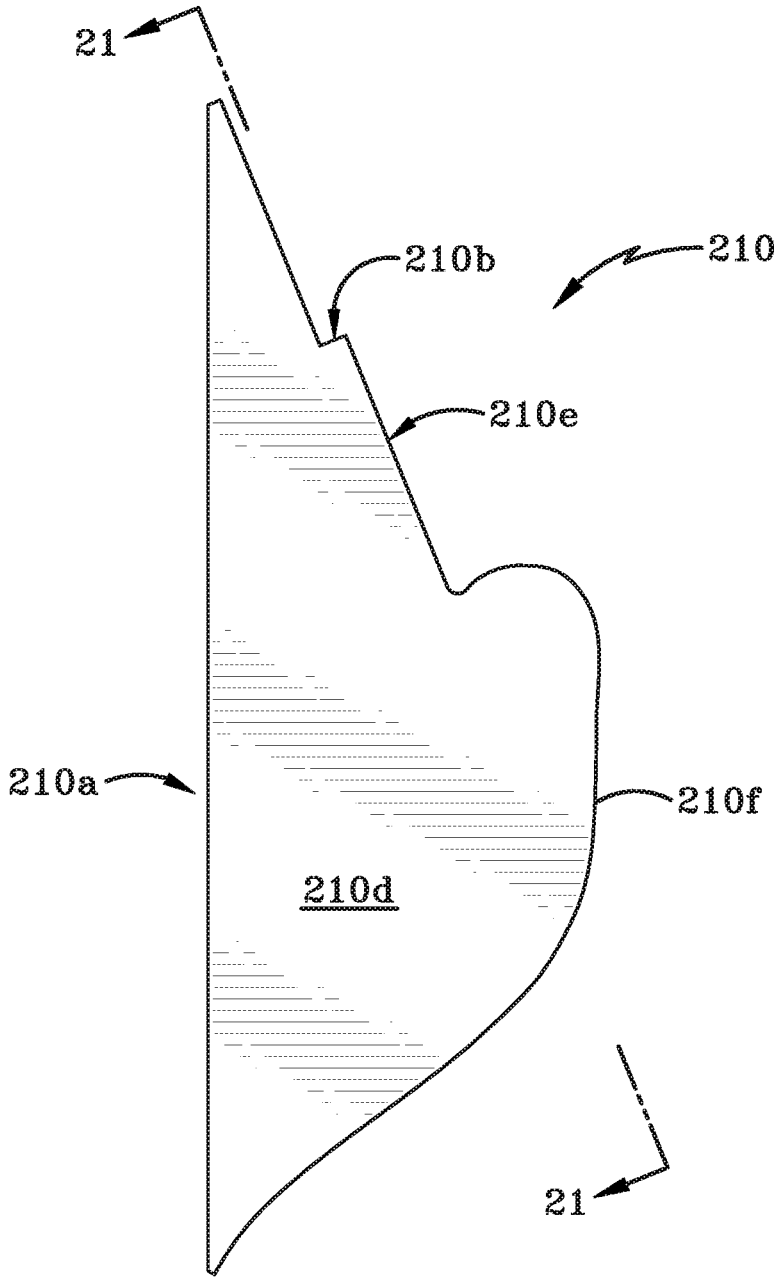
FIG. 19 is a left side elevation view of the folded stackable acoustic horn of FIG. 18.
Figure 20:
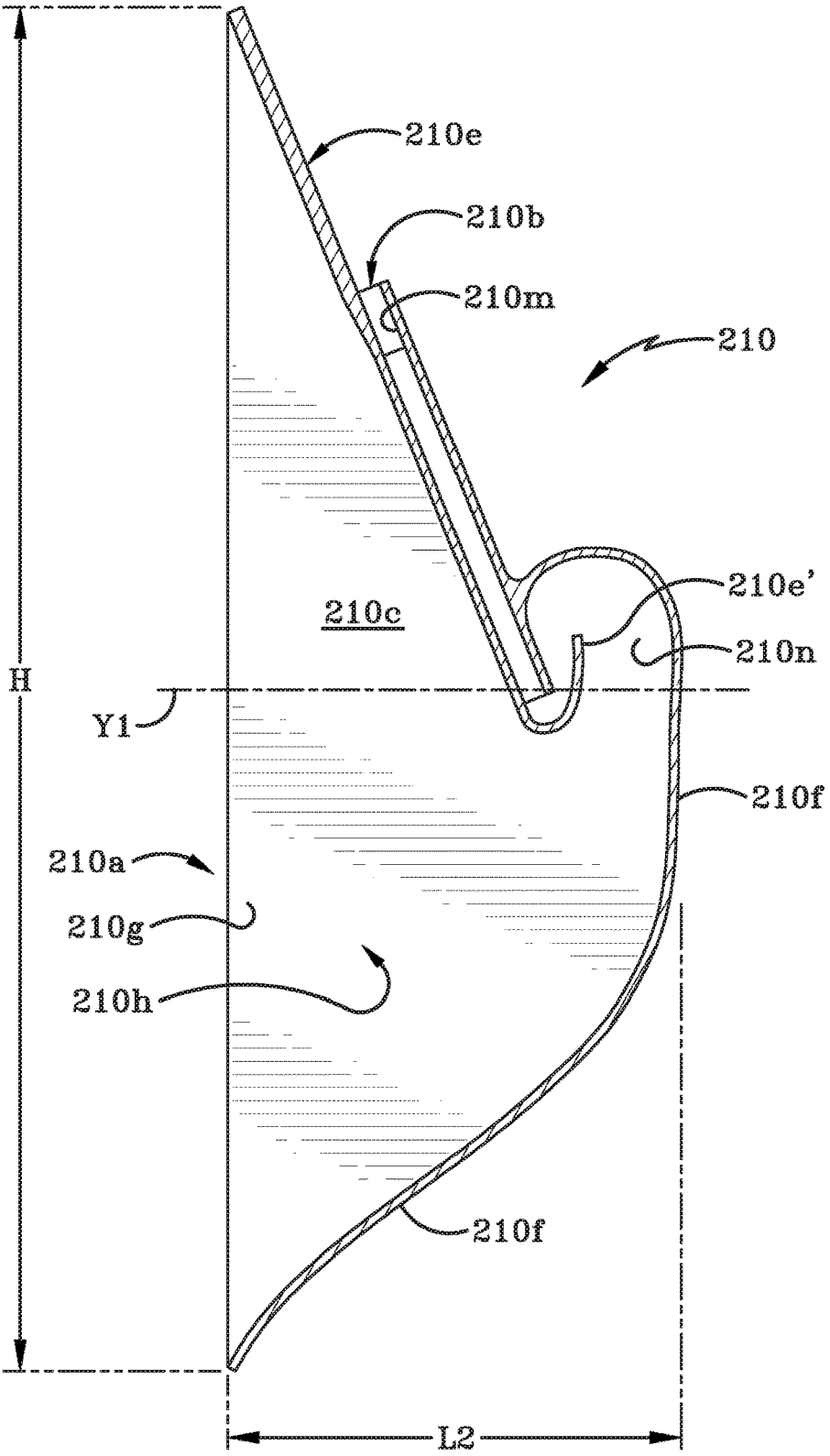
FIG. 20 is a cross-section of the folded stackable acoustic horn taken along line 20-20 of FIG. 18.
Figure 21:
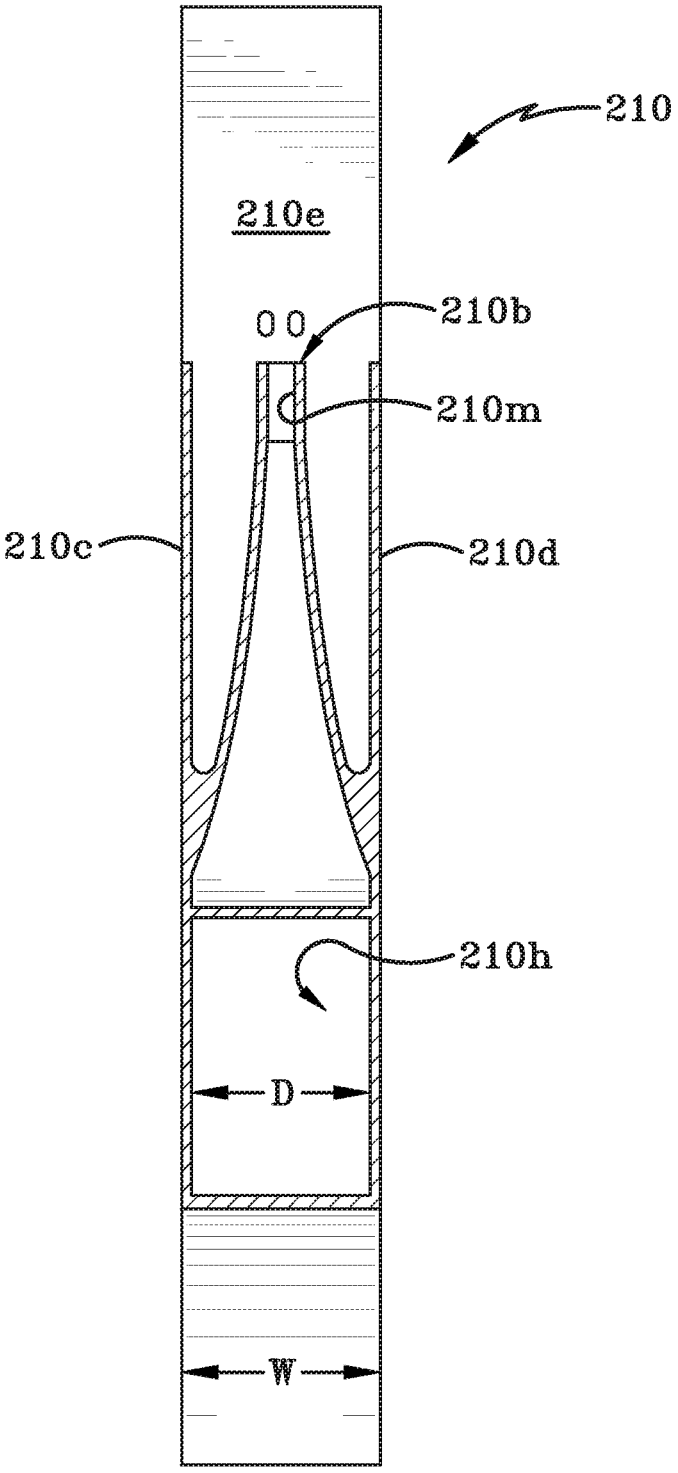
FIG. 21 is a top plan view of the folded stackable acoustic horn taken along line 21-21 of FIG. 19.

In accordance with an aspect of the present disclosure and as shown in FIGS. 19 and 20, top wall 210*e* and bottom wall 210*f* of folded stackable acoustic horn 210 are dissimilar in configuration. Top wall 210*e* and bottom wall 210*f* are not symmetrical about a longitudinal axis "Yl" (FIG. 19) that is oriented at right angles to the leading edges of first side 210*c* and second side 210*d*. Top wall 210*e* may be configured so as to form a curved region 210*e*' within interior cavity 210*h*. The curved region 210*e*' may create a passageway 210*n* through which sounds must travel in order to reach throat 210*b* and thereby any microphone inserted into throat 210*b*.

Similar to stackable acoustic horn 10, folded stackable acoustic horn 210 may be of a height "H" measured from the leading edge of top wall 210*e* to a leading edge of bottom wall 210*f*. Folded stackable acoustic horn 210 may be of a width "W" that is similar to the width of stackable acoustic horn 10, where the width "W" is measured from the leading edge of first side 210*c* to the leading edge of second side 210*d*. However, unlike stackable acoustic horn 10, folded stackable acoustic horn 210 is of a substantially smaller length "L2" as measured from a plane aligned with the leading edges of the first and second sides 210*c*, 210*d*, and a rearmost region of bottom wall 210*f*. The length of stackable acoustic horn 10 in one example may be of a length "L" that is approximately 17.9 inches long while the length "L2" of folded stackable horn 210 may be approximately 5.1 inches in length. Each horn diminishes in interior area from mouth 210*a* to throat 210*b* thereof and is vertically taller and longitudinally deeper than it is wide.

It will be understood that similar to stackable acoustic horn 10, folded stackable acoustic horn 210 shown in the attached figures has a parametrically decreasing area as viewed from mouth 210*a* of horn 210 and the same constraints regarding the decreasing area apply to equally to the folded stackable acoustic horn 210 as they do relative to the stackable horn 10 shown in FIGS. 1-17.

It will be understood that similar to stackable acoustic horn 10, a plurality of folded stackable acoustic horns 210 may be formed into a variety of differently configured arrays. A single horn 210 or an array of a plurality of horns 210 may be secured to a support. In the array, the horns may be similar or identical to each other and may be arranged side-by-side with a space in between or in abutting contact with each other. An aperture 210*m* is defined in the throat 210*b* of each horn 210 and a microphone (similar to microphone 20) may be positioned within the throat 210*b* of each horn 210 in the array. Similar to an array of horns 10, the arrangement of horns 210 in an array permits beamforming and as a result allows simultaneous detection, tracking, and identification of multiple targets. Listening distance is greatly increased by utilizing the horn 210 or an array of horns 210.

It will be understood by one of ordinary skill in the art that there are a myriad of ways to accomplish the basic concept of a horn that is narrow in one direction and wide in the other direction resulting in a beam that is wide in one direction and narrow in the perpendicular direction. The stackable horn narrows the beam in one direction and is particularly useful when the target is expected to stay within that beam. For example, people on the ground cannot move up and down from the ground so the beam does not need to be electronically steered in the vertical direction. It would be required to steer the beam from side to side. This disclosure takes advantage of that situation. Steering in only one direction substantially reduces the number of microphones.

Various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

The above-described embodiments can be implemented in any of numerous ways. For example, embodiments of technology disclosed herein may be implemented using hardware, software, or a combination thereof. When implemented in software, the software code or instructions can be executed on any suitable processor or collection of processors, whether provided in a single computer or distributed among multiple computers. Furthermore, the instructions or software code can be stored in at least one non-transitory computer readable storage medium.

Also, a computer or smartphone utilized to execute the software code or instructions via its processors may have one or more input and output devices. These devices can be used, among other things, to present a user interface. Examples of output devices that can be used to provide a user interface include printers or display screens for visual presentation of output and speakers or other sound generating devices for audible presentation of output. Examples of input devices that can be used for a user interface include keyboards, and pointing devices, such as mice, touch pads, and digitizing tablets. As another example, a computer may receive input information through speech recognition or in other audible format.

Such computers or smartphones may be interconnected by one or more networks in any suitable form, including a local area network or a wide area network, such as an enterprise network, and intelligent network (IN) or the Internet. Such networks may be based on any suitable technology and may operate according to any suitable protocol and may include wireless networks, wired networks or fiber optic networks.

The various methods or processes outlined herein may be coded as software/instructions that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine.

In this respect, various inventive concepts may be embodied as a computer readable storage medium (or multiple computer readable storage media) (e.g., a computer memory, one or more floppy discs, compact discs, optical discs, magnetic tapes, flash memories, USB flash drives, SD cards, circuit configurations in Field Programmable Gate Arrays or other semiconductor devices, or other non-transitory medium or tangible computer storage medium) encoded with one or more programs that, when executed on one or more computers or other processors, perform methods that implement the various embodiments of the disclosure discussed above. The computer readable medium or media can be transportable, such that the program or programs stored thereon can be loaded onto one or more different computers or other processors to implement various aspects of the present disclosure as discussed above.

The terms "program" or "software" or "instructions" are used herein in a generic sense to refer to any type of computer code or set of computer-executable instructions that can be employed to program a computer or other processor to implement various aspects of embodiments as discussed above. Additionally, it should be appreciated that according to one aspect, one or more computer programs that when executed perform methods of the present disclosure need not reside on a single computer or processor, but may be distributed in a modular fashion amongst a number of different computers or processors to implement various aspects of the present disclosure.

Computer-executable instructions may be in many forms, such as program modules, executed by one or more computers or other devices. Generally, program modules include routines, programs, objects, components, data structures, etc. that perform particular tasks or implement particular abstract data types. Typically the functionality of the program modules may be combined or distributed as desired in various embodiments.

Also, data structures may be stored in computer-readable media in any suitable form. For simplicity of illustration, data structures may be shown to have fields that are related through location in the data structure. Such relationships may likewise be achieved by assigning storage for the fields with locations in a computer-readable medium that convey relationship between the fields. However, any suitable mechanism may be used to establish a relationship between information in fields of a data structure, including through the use of pointers, tags or other mechanisms that establish relationship between data elements.

All definitions, as defined and used herein, should be understood to control over dictionary definitions, definitions in documents incorporated by reference, and/or ordinary meanings of the defined terms.

"Logic", as used herein, includes but is not limited to hardware, firmware, software, and/or combinations of each to perform a function(s) or an action(s), and/or to cause a function or action from another logic, method, and/or system. For example, based on a desired application or needs, logic may include a software controlled microprocessor, discrete logic like a processor (e.g., microprocessor), an application specific integrated circuit (ASIC), a programmed logic device, a memory device containing instructions, an electric device having a memory, or the like. Logic may include one or more gates, combinations of gates, or other circuit components. Logic may also be fully embodied as software. Where multiple logics are described, it may be possible to incorporate the multiple logics into one physical logic. Similarly, where a single logic is described, it may be possible to distribute that single logic between multiple physical logics.

Furthermore, the logic(s) presented herein for accomplishing various methods of this system may be directed towards improvements in existing computer-centric or internet-centric technology that may not have previous analog versions. The logic(s) may provide specific functionality directly related to structure that addresses and resolves some problems identified herein. The logic(s) may also provide significantly more advantages to solve these problems by providing an exemplary inventive concept as specific logic structure and concordant functionality of the method and system. Furthermore, the logic(s) may also provide specific computer implemented rules that improve on existing technological processes. The logic(s) provided herein extends beyond merely gathering data, analyzing the information, and displaying the results. Further, portions or all of the present disclosure may rely on underlying equations that are derived from the specific arrangement of the equipment or components as recited herein. Thus, portions of the present disclosure as it relates to the specific arrangement of the components are not directed towards abstract ideas. Furthermore, the present disclosure and the appended claims present teachings that involve more than performance of well-understood, routine, and conventional activities previously known to the industry. In some of the method or process of the present disclosure, which may incorporate some aspects of natural phenomenon, the process or method steps are additional features that are new and useful.

The indefinite articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

An embodiment is an implementation or example of the present disclosure. Reference in the specification to "an embodiment," "one embodiment," "some embodiments," "one particular embodiment," "an exemplary embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," "an exemplary embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

Additionally, the method of performing the present disclosure may occur in a sequence different than those described herein. Accordingly, no sequence of the method should be read as a limitation unless explicitly stated. It is recognizable that performing some of the steps of the method in a different order could achieve a similar result.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

The invention claimed is:

1. A listening device comprising: a plurality of stackable acoustic horns that are stacked side-by side to form the acoustic array; wherein each of the plurality of stackable acoustic horns has a body that includes: a first side; a second side that is opposed to the first side; a top wall and a bottom wall extending between the first side and the second side; wherein the first side, the second side, the top wall and the bottom wall bound and define an interior cavity; a mouth provided at one end of the body; said mouth defining an opening to the interior cavity; a throat provided on the body a distance from the mouth; said throat defining an aperture that is in fluid communication with the interior cavity; wherein the interior cavity has a parametrically decreasing area as viewed from the mouth to the throat; and a microphone carried in the throat of at least some of the plurality of stackable acoustic horns; wherein a distance from a first side surface of each of the plurality of stackable acoustic horns in the acoustic array to a second side surface of each of the plurality of stackable acoustic horns in the acoustic array is sufficiently narrow enough to allow the plurality of stackable acoustic horns to be arranged in the acoustic array in a configuration that permits a beamforming function to be performed without spatial aliasing and wherein the rate of decrease in the area of the interior cavity of at least one of the plurality of stackable acoustic horns is based on an area of the throat aperture and a lowest frequency of operation of the stackable acoustic horn.

2. The listening device according to claim 1, wherein the parametrically decreasing area of the interior cavity of at least one of the plurality of stackable acoustic horns is determined utilizing one or more exponential equations, conic equations, parabolic equations, hyperbolic equations, and tractrix equations.

3. The listening device according to claim 1, wherein the first side and the second side of at least one of the plurality of stackable acoustic horns are parallel to each other.

4. The listening device according to claim 1, wherein the first side and the second side of at least one of the plurality of stackable acoustic horns angles inwardly towards each other moving in a direction from the mouth to the throat of at least one of the plurality of stackable acoustic horns.

5. The listening device according to claim 1, wherein one or both of the first side and the second side of at least one of the plurality of stackable acoustic horns is convexly curved moving in a direction from the mouth to the throat of at least one of the plurality of stackable acoustic horns.

6. The listening device according to claim 1, wherein at least one of the top wall and the bottom wall of at least one of the plurality of stackable acoustic horns is folded at least once toward the other of the top wall and the bottom wall or is folded at least once toward the mouth of at least one of the plurality of stackable acoustic horns.

7. The listening device according to claim 1, wherein one or both of the top wall and the bottom wall of at least one of the plurality of stackable acoustic horns angles inwardly towards the other moving in a direction from the mouth to the throat of at least one of the plurality of stackable acoustic horns.

8. The listening device according to claim 1, wherein one or both of the top wall and the bottom wall of at least one of the plurality of stackable acoustic horns are convexly curved.

9. The listening device according to claim 1, wherein the first side of a first stackable acoustic horn of the plurality of stackable acoustic horns is in abutting contact with the second side of a second stackable acoustic horn of the plurality of stackable acoustic horns.

10. The listening device according to claim 1, wherein the first side of a first stackable acoustic horn of the plurality of stackable acoustic horns is spaced a distance laterally apart from the second side of a second stackable acoustic horn of the plurality of stackable acoustic horns.

11. The listening device according to claim 1, wherein the top walls of the plurality of stackable acoustic horns are aligned with each other in the acoustic array.

12. The listening device according to claim 1, wherein the top walls of adjacent stackable acoustic horns of the plurality of stackable acoustic horns are offset relative to each other in the acoustic array.

13. A method of locating, tracking and/or identifying objects utilizing sound comprising:

stacking a plurality of stackable acoustic horns into an array;

decreasing an area of an interior cavity defined in each stackable acoustic horn of the plurality of stackable acoustic horns from a mouth opening of the stackable acoustic horn towards a throat aperture thereof;

placing the array in a location and direction that is advantageous for receiving sound from at least one sound-generating object remote from the array, wherein the at least one sound-generating object propagates sound towards the array;

receiving the sound from the at least one sound-generating object into the mouth opening of at least some of the plurality of stackable acoustic horns;

focusing the received sounds towards the throat aperture of the at least some of the plurality of stackable acoustic horns having the decreasing area of the interior cavity;

receiving the focused sound with a microphone carried in the at least some of the plurality of stackable acoustic horns; and performing a beamforming operation utilizing the sound received by the microphones, wherein stacking comprises placing the stackable acoustic horns side-by-side and spacing a first side surface of each of the plurality of stackable acoustic horns in the array a distance away from a second side surface of each of the plurality of stackable acoustic horns in the array; and selecting the distance between the first side surface and the second side surface to be sufficiently narrow to allow the plurality of stackable acoustic horns to be arranged in the array in a configuration that permits a beamforming function to be performed without spatial aliasing and wherein the rate of decrease in the area of the interior cavity of at least one of the plurality of stackable acoustic horns is based on an area of the throat aperture and a lowest frequency of operation of the stackable acoustic horn.

14. The method according to claim 13, wherein the stacking of the plurality of stackable acoustic horns includes:

spacing a first side surface of each of the plurality of stackable acoustic horns in the array a distance away from a second side surface of each of the plurality of stackable acoustic horns in the array; and selecting the distance between the first side surface and the second side surface to be sufficiently narrow to allow the plurality of stackable acoustic horns to be arranged in the array in a configuration that permits a beamforming function to be performed without spatial aliasing.

15. The method according to claim 13, wherein the stacking of the plurality of stackable acoustic horns includes placing a first side of a first stackable acoustic horn of the plurality of stackable acoustic horns in abutting contact with a second side of an adjacent second stackable acoustic horn of the plurality of stackable acoustic horns.

16. The method according to claim 13, wherein the stacking of the plurality of stackable acoustic horns includes laterally spacing a first side of a first stackable acoustic horn of the plurality of stackable acoustic horns a distance from a second side of an adjacent second stackable acoustic horn of the plurality of stackable acoustic horns.

17. The method according to claim 13, wherein decreasing the area of the interior cavity of each stackable acoustic horn in the plurality of stackable acoustic horns is accomplished by decreasing a distance between a top wall and a bottom wall of each stackable acoustic horn and in a direction moving from the mouth opening to the throat aperture thereof.

18. The method according to claim 13, wherein decreasing the area of the interior cavity of each stackable acoustic horn in the plurality of stackable acoustic horns is accomplished by decreasing a distance between a first side and a second side of each stackable acoustic horn and in a direction moving from the mouth opening to the throat aperture thereof.

19. The method according to claim 13, wherein the decreasing of the area of the interior cavity of each stackable acoustic horn in the plurality of stackable acoustic horns is accomplished by folding at least one of a top wall and a bottom wall of each stackable acoustic horn at least once toward the other of the top wall and the bottom wall, or folding at least one of the top wall and the bottom wall of each stackable acoustic horn at least once toward the mouth opening of a respective stackable acoustic horn.

20. The method according to claim 13, further comprising:

operatively engaging each of the microphones with a computing device; and programming the computing device with software to do one or more of locate, track, and identify objects based on sound.

21. The method according to claim 20, further comprising;

comparing a known acoustic signature for a class of objects with the received sound; and identifying the at least one sound-generating object based on the comparison of the known acoustic signature and the received sound.

22. The method according to claim 13, further comprising decreasing the area of the interior cavity of each stackable acoustic horn in the plurality of stackable acoustic horns parametrically; and determining the parametrically decreasing area of each stackable acoustic horn utilizing one or more exponential equations, conic equations, parabolic equations, and tractrix equations.

* * * * *